US008033756B2

(12) United States Patent
Adamson

(10) Patent No.: US 8,033,756 B2
(45) Date of Patent: Oct. 11, 2011

(54) DEEP WATER PILE DRIVER

(76) Inventor: James E. Adamson, West Palm Beach, FL (US)

( * ) Notice: Subject to any disclaimer, the term of this patent is extended or adjusted under 35 U.S.C. 154(b) by 317 days.

(21) Appl. No.: 12/454,446

(22) Filed: May 18, 2009

(65) Prior Publication Data

US 2010/0012336 A1 Jan. 21, 2010

Related U.S. Application Data

(60) Provisional application No. 61/135,373, filed on Jul. 21, 2008.

(51) Int. Cl.
*E02D 7/08* (2006.01)

(52) U.S. Cl. ..... 405/228

(58) Field of Classification Search ..... 405/224, 405/227, 228, 231, 232
See application file for complete search history.

(56) References Cited

U.S. PATENT DOCUMENTS

| | | | | | |
|---|---|---|---|---|---|
| 2,798,363 | A * | 7/1957 | Hazak et al. | ..... | 405/245 |
| 3,842,917 | A * | 10/1974 | Wisotsky | ..... | 405/228 |
| 3,922,869 | A * | 12/1975 | Wisotsky | ..... | 405/228 |
| 4,051,685 | A * | 10/1977 | Jansz | ..... | 405/228 |
| 4,075,858 | A * | 2/1978 | Frederick | ..... | 405/228 |
| 4,109,475 | A * | 8/1978 | Schnell | ..... | 405/228 |
| 4,484,638 | A * | 11/1984 | West | ..... | 405/232 |
| 4,817,734 | A * | 4/1989 | Kuehn | ..... | 405/228 |
| 4,872,514 | A * | 10/1989 | Kuehn | ..... | 405/228 |
| 5,662,175 | A * | 9/1997 | Warrington et al. | ..... | 173/132 |
| 5,667,341 | A * | 9/1997 | Kuehn | ..... | 405/228 |
| 5,788,418 | A * | 8/1998 | Kuehn | ..... | 405/228 |
| 5,915,883 | A * | 6/1999 | Kuehn | ..... | 405/228 |
| 7,770,655 | B2 * | 8/2010 | Wilde et al. | ..... | 405/228 |

FOREIGN PATENT DOCUMENTS

WO WO 2006109018 A1 * 10/2006

* cited by examiner

*Primary Examiner* — Frederick L Lagman
(74) *Attorney, Agent, or Firm* — Stephen S. Hodgson

(57) ABSTRACT

A pile driver is provided for use in deep water with a remotely operated vehicle (ROV) and a working ship for setting piles, pin piles and well conductors in subsea soil and for soil sampling in deep water and can be used for shallow water and land-based applications. A ram mass or hammer is received in an open frame and hydraulically reciprocated while in contact with water. A piston rod received in a piston cylinder is secured at one end to the hammer through a coupling mechanism, and an external source of hydraulic power is used with an on-board hydraulic circuit. Gas is compressed during an up-stroke to store energy, which is released during a down-stroke to push the hammer downwardly. The coupling mechanism provides a connection between the piston rod and the hammer that can move between an essentially rigid lift connection, an essentially rigid downward-push connection and an essentially non-rigid impact connection for preventing buckling of the piston rod when the hammer strikes at its lowermost point. One embodiment of the coupling mechanism includes a hollow body having opposing longitudinal slots, a rod slideably received in the hollow body that is pinned slideably at one end in the opposing slots and pinned fixedly at the other end to the hammer, with a spring in the hollow body providing a bias to push the rod toward the hammer.

36 Claims, 7 Drawing Sheets

3
46d
46c
30
46b
46
62i
62c
62b
62d
62f
62j
62
62k
62h
62b
64b
62e
62g
64c
62a
42
64a
34c
34d
32d
34a
34a
32
34
34b
36
40b
40a
40c
38
3

46b
46d
46c
46
46a
60a
62c
44e
62
44c
44
62b
60c
62f
60
80
44a
58b
62d
44a
44b
44d
44a
42a
62a
42
64b
34c
62c
42b
34d
32d
34
34a
52b
60b
56
32
60c
32a
58
54
58a
54b
54g
48
52a
34b
54d
54e
50
36
36a
40a
40b
36b
36c
54c
54a
32c
36e
38
36d 56
56
58
56
56c
60
60
60c
56a
56b
32d
56h
56f
56g
32d
56d
58
58a
54
54b
54g
54g
54f
32
48
52a
54d
50
54e
36
54c
32c
36b
54a
54c 58c
88
60
60
56c
60c
32d
56
56a
56b
56e
56g
56f
56h
56d
58
58a
32
54g
54
54f
52a
52a
48
50
54e
54c
36
54d
54d
54b
36b
54c
54a
36d

DEEP WATER PILE DRIVER

CROSS REFERENCE TO RELATED APPLICATION

Priority is claimed to U.S. Provisional Patent Application Ser. No. 61/135,373 filed by the inventor on Jul. 21, 2008, which is incorporated by reference.

BACKGROUND OF THE INVENTION

1. Field of the Invention

This present invention pertains to pile drivers, and more particularly to a ramming apparatus, a system incorporating the ramming apparatus and methods and applications for driving objects into soil under deep water.

2. Description of the Related Art

Large, heavy, surface-powered hammering devices exist for the purpose of vertically forcing piles, well conductors, soil sampling devices, and other objects into subsea soil. Existing hammering devices are very large, very expensive to deploy, and because of their size and complexity, existing hammering devices tend to be limited to relatively shallow seawater depths and to driving relatively large objects. Current technology also includes drilling a hole and/or jetting a hole into the ocean floor, then inserting an object into the hole, but these techniques require a very large, expensive ship or platform and a considerable amount of time for installing the object. Also, in the case of piles, well conductors and other objects that are to remain in the soil, the objects need to be longer than would be necessary if the objects were instead driven into the subsea soil. This is due to the reduced holding capacity or strength of an object that is placed in a drilled or jetted hole, because of the soil disturbance at the walls of the hole and also the enlarged size of the hole relative to the object.

U.S. Pat. No. 5,662,175, issued to Warrington et al. and incorporated by reference, describes a pile hammer that can be used under water, which uses water as a hydraulic fluid. A hydraulic power pack is located at the surface and connected by hoses to a hydraulically-operated ram. There is a practical limit to the depth at which the pile hammer can be used because it is impractical to pump water through hoses to a great depth.

U.S. Pat. Nos. 4,872,514; 5,667,341; 5,788,418; and 5,915,883, issued to Kuehn and incorporated by reference, describe, in general, pile drivers that can be used in relatively deep water. Kuehn's '883 patent describes a submersible hydraulic driving unit that can be connected to the driving mechanism of an underwater ramming apparatus or cut-off tool. The driving unit has a hydraulic pump powered by an electric motor, which receives electricity from the surface through an umbilical cable. The driving unit has another umbilical cable that plugs into the ramming apparatus or cut-off tool, and a remotely-operated vehicle (ROV) is used to observe and make that connection. In the process of lowering equipment supported by an umbilical cable, the umbilical cable is prone to damage, and Kuehn's '341 patent describes using the umbilical cable of an ROV for signal and data transmission with a driving unit.

International Patent Application No. PCT/GB2006/001239, bearing International Publication No. WO2006109018, invented by Clive Jones and incorporated by reference for all purposes, describes an apparatus for driving a pile into an underwater seabed, which includes a pile guide that includes a base frame, a guide member mounted on the base frame and configured to guide a pile, a device for driving the pile into the seabed, and a power supply for supplying power to drive the device. The Jones application describes a power supply that is part of a remotely operated vehicle (ROV). Jones discloses that hydraulic hammers such as the IHC Hydrohammers supplied by Dutch Company IHC Hydrohammer BV can be used as the pile driving device. According to an IHC brochure, the IHC Hydrohammer includes a hammer and a piston rod constructed as a single piece and an enclosure for the hammer, which indicates that the assembly is designed so that the hammer reciprocates in an essentially clean, dry, gaseous environment, which is an environment that is difficult to maintain while under the pressure imparted by very deep water.

SUMMARY OF THE INVENTION

In one embodiment, the present invention provides a ramming apparatus that includes a hammer frame having an upper end and a lower end and a side wall extending between the upper and lower ends, where the sidewall has openings adapted for the passage of water through the sidewall; a hammer received in the hammer frame, where the hammer frame and the hammer are adapted for reciprocation of the hammer inside the hammer frame, and where the ram is adapted for operation while in contact with water. The hammer comprises a heavy body having upper and lower surfaces, an upper hammer guide extending upwardly from the upper surface of the heavy body and a lower hammer guide extending downwardly from the lower surface of the heavy body. The upper hammer guide, the heavy body and the lower hammer guide have a co-axial bore, and the frame has an upper guide opening for receiving the upper hammer guide and a lower guide opening for receiving the lower hammer guide. The ramming apparatus has an anvil in the lower end of the ram frame, and the anvil is adapted to receive and transmit the force of impact from the hammer. A hydraulics frame is coupled to the hammer frame; a hydraulic cylinder is received in the hydraulics frame; a piston is received in the hydraulic cylinder; and a piston rod is attached to the piston. A coupling mechanism is adapted to couple the other end of the piston rod to the hammer, and the coupling mechanism provides an essentially rigid connection between the piston rod and the hammer as the hammer is lifted and an essentially non-rigid connection between the piston rod and the hammer as the hammer impacts the anvil. A hydraulic fluid circuit is adapted to provide a lifting force for lifting the hammer and to release the hammer. Preferably, a skirt extends from the lower end of the hammer frame, and the skirt is adapted for contact with an object that is to be driven into soil and to receive and transmit the force of impact from the hammer to the object that is to be driven into soil; In one embodiment, the coupling mechanism provides a connection between the piston rod and the hammer that can move between an essentially rigid lift connection, an essentially rigid downward-push connection and an essentially non-rigid impact connection for preventing buckling of the piston rod.

Preferably, the hydraulic fluid circuit includes a tuneable gas spring comprising a container in which a gas is stored, where the gas is compressed as the hammer is lifted, where the gas expands after the hammer is released, and where the expansion of the gas provides a downward force that is used to push the hammer downwardly. The downward force from the expanding gas is preferably transmitted through the piston rod to the hammer through the coupling mechanism, and preferably, the coupling mechanism and/or the hydraulic fluid circuit is adapted to prevent the piston rod from ramming into the hammer at about the moment that the anvil receives the force of the impact from the hammer.

The coupling mechanism in one embodiment includes a hollow, tubular rod connector element having a lower end and an upper end; a hammer connector element having a longitudinal portion and a transverse portion, where the transverse portion is received inside the hollow, tubular rod connector element, and a spring device received within the hollow, tubular rod connector element between the upper end of the hollow, tubular rod connector element and the transverse portion of the hammer connector element, wherein the hammer connector element can reciprocate to a limited extent with respect to the hollow, tubular rod connector element. The transverse portion of the hammer connector element preferably presses against the lower end of the hollow, tubular rod connector element while the hammer is lifted to provide an essentially rigid connection between the piston rod and the hammer, and preferably, the transverse portion of the hammer connector element moves away from the lower end of the hollow, tubular rod connector element and presses against the spring device as the hammer is pushed downwardly. The downward speed of the piston rod is preferably slowed immediately before the hammer impacts the anvil.

In another embodiment, the present invention provides a system for driving an object into soil under water and includes a hammer or ram adapted for driving the object into the soil under water; a lift mechanism operatively coupled to the hammer, the lift mechanism being adapted to lift the hammer; a release mechanism operatively coupled to the lift mechanism and/or to the hammer, the release mechanism being adapted to release the hammer after the hammer is lifted; a frame adapted to operatively receive the hammer, a structure on the surface of the water; a lifting line between the structure and the hoist connector on the frame; a remotely operated vehicle (ROV); an ROV umbilical cable extending between the structure and the ROV, the ROV umbilical cable being adapted to provide electricity and control signals from the structure to the ROV; and a hammer umbilical adapted to operatively extend between the ROV and the lift mechanism for allowing the ROV to actuate the lift mechanism, where the ROV has a propulsion system that enables movement of the ROV, and where the ROV is adapted to operatively connect the hammer umbilical to the lift mechanism. The lift mechanism preferably includes a hydraulic cylinder having a piston therein and a piston rod attached to the piston, the piston rod is attached to the hammer for lifting the hammer, and the release mechanism further includes a pushing mechanism adapted to push the hammer downwardly with the piston rod after the hammer is released. Preferably, the attachment of the piston rod to the hammer is adapted to prevent the piston rod from pushing the hammer downwardly at about the moment that the hammer reaches its lowermost point. The push mechanism is preferably adapted such that the downward speed of the piston rod is less than the downward speed of the hammer immediately prior to the hammer reaching its lowermost point. The attachment of the piston rod to the hammer is preferably adapted such that the connection between the piston rod and the hammer is essentially rigid while the hammer is lifted upwardly, but the connection between the piston rod and the hammer is not rigid at the time the hammer reaches its lowermost point.

In one embodiment, the piston rod is preferably attached to the hammer through a rod-hammer attachment member, which includes a tubular member having opposing slots that are oriented with a vertical longitudinal axis, the slots having a lower end and an upper end; a pin having a longitudinal axis oriented horizontally, the pin being received in the slots such that the pin contacts the lower end of the slots to provide an essentially rigid connection between the piston rod and the hammer while the hammer is lifted; and a spring mechanism received within the tubular member above the pin such that, while the piston rod pushes the hammer downwardly, force is transmitted through the spring mechanism to the pin, wherein the pin slides upwardly within the opposing slots initially when the piston rod pushes the hammer downwardly. The piston rod in one embodiment is attached to the hammer through a rod-hammer attachment member that includes a tubular element having upper and lower ends and a longitudinal axis; a T-shaped element having a longitudinal portion and a transverse portion, wherein the transverse portion is slideably received in the tubular element, and wherein the longitudinal portion has a longitudinal axis that is essentially co-axial with the longitudinal axis of the tubular element; and a spring device received in the tubular element between the upper end of the tubular element and the transverse portion of the T-shaped element, where the spring device is adapted to push the transverse portion toward the lower end of the tubular element.

The present invention also provides a method for driving an object into soil below water that includes the steps of lowering a ramming apparatus into a body of water, where the ramming apparatus includes a frame having an upper end and a lower end; a ram received in the frame; a hydraulics sub-frame attached to the frame; a hydraulic cylinder received in the frame; a piston received in the hydraulic cylinder; a piston rod attached to the piston and coupled to the ram; and a first hydraulic circuit adapted to lift the ram via the hydraulic cylinder, piston and piston rod and to release the ram, whereby the release of the ram allows the ram to fall due to gravity, where the ramming apparatus is adapted to impart a ramming force on the object that is to be driven into soil below water; lowering an ROV into the water, where the ROV is adapted to have a second hydraulic circuit, and where the ROV is adapted for remote control that allows the ROV to be moved under the water by a propulsion system on the ROV, and to connect the second hydraulic circuit on the ROV to the first hydraulic circuit on the ramming apparatus, and where the ROV and the first and second hydraulic circuits provide a capability for operating the ramming apparatus through the ROV; and using the ramming apparatus to drive the object into soil below the water. Applications for the present invention include driving piles, pin piles, well conductors and soil sampling devices into subsea soil. Piles and/or pin piles can be used to anchor mud mats, underwater pipelines, and various structural marine elements.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF EXEMPLARY EMBODIMENTS

The present invention provides a ramming or hammering apparatus that can be used in very deep water and a method and system for using the apparatus. The apparatus can be used for driving piles, driving pipe for use as a well conductor in deep water and for driving a soil sampling device into subsea soil. The ramming or hammering apparatus can be used in shallower water and on land, but it is believed that it is particularly useful in deep water applications.

Figure 1:
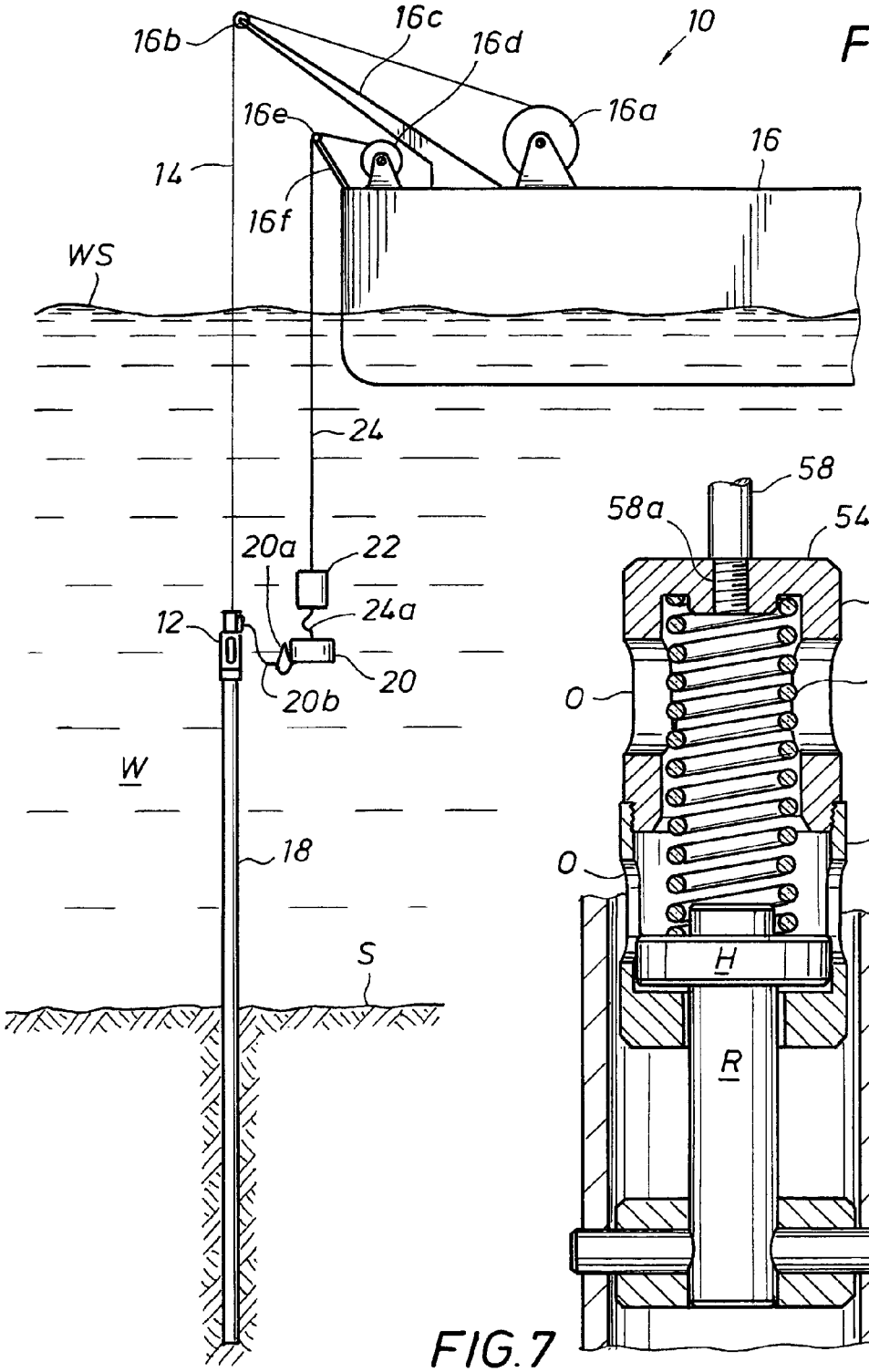
FIG. 1 is a side elevation of a system for ramming an object into subsea soil, according to the present invention.

Turning to the drawings and with reference to FIG. 1, a side elevation of a ramming or hammering system 10 is shown, according to the present invention. A ramming or hammering apparatus 12 is connected by a lifting line 14 to a water vessel 16, such as a ship or a barge, via a winch 16*a* that can be used to lower and raise ramming apparatus 12. Lifting line 14 passes through a pulley 16*b* that is attached to a crane boom 16*c*. Hammering apparatus 12 is illustrated in this embodiment as driving a pile 18 into subsea soil S, which may be thousands of feet below a surface WS of a body of water W. Pile 18 is shown as partially driven into subsea soil S, and ramming apparatus 12 can be used from the beginning of a process for hammering or driving the pile 18 into subsea soil S through the completion of the driving process. In this embodiment, the object being driven by ramming apparatus 12 is pile 18, but other objects that can be driven by ramming apparatus 12 include well conductors, soil samplers and various types of anchors such as for anchoring mud mats and underwater pipelines. Ramming apparatus 12 is shown as supported by water vessel 16, but ramming apparatus 12 could be supported from any water-based or land-based structure, such as various types of floating and anchored oil platforms for water-based structures and various types of derrick-like structures for land-based systems.

Ramming or hammering apparatus 12 is illustrated in this embodiment as being powered hydraulically by a remotely operated vehicle 20, which is referred to as an ROV. ROV 20 is initially received in a lifting cage or garage 22, which is used to safely lower ROV 20 from water vessel 16 into the water W. Lifting cage 22 and ROV 20 are supported by an ROV umbilical cable 24, which is connected to water vessel 16 via a winch 16*d*. ROV umbilical cable 24 passes through a pulley 16*e*, which is attached to a crane boom 16*f* on water vessel 16. After lifting cage 22 is lowered into proximity to ramming apparatus 12, ROV 20, which has a propulsion system for movement under water, is activated and guided by an operator, which is typically, but not necessarily, a human working through a computer system, and ROV 20 is moved into close proximity with hammering apparatus 12. ROV 20 is tethered to lifting cage 22 by a second segment 24*a* of ROV umbilical cable 24. ROV umbilical cable 24 and 24*a* has control and signal lines for passage of commands and signals from water vessel 16 to ROV 20 and for receiving data and feedback signals from ROV 20 onto water vessel 16. Additionally, ROV umbilical cable 24 and 24*a* has electrical power conductors which are used to drive its own on-board hydraulic system. ROV 20 has a manipulator arm 20*a*, which is used to connect a pair of hydraulic hoses 20*b* to ramming apparatus 12. U.S. Pat. No. 4,947,782, issued to Takahashi and incorporated by reference, describes a remotely operated vehicle. A suitable ROV can be obtained from Perry Slingsby Systems, Inc. of Houston, Tex.

Ramming Apparatus

Figure 2:
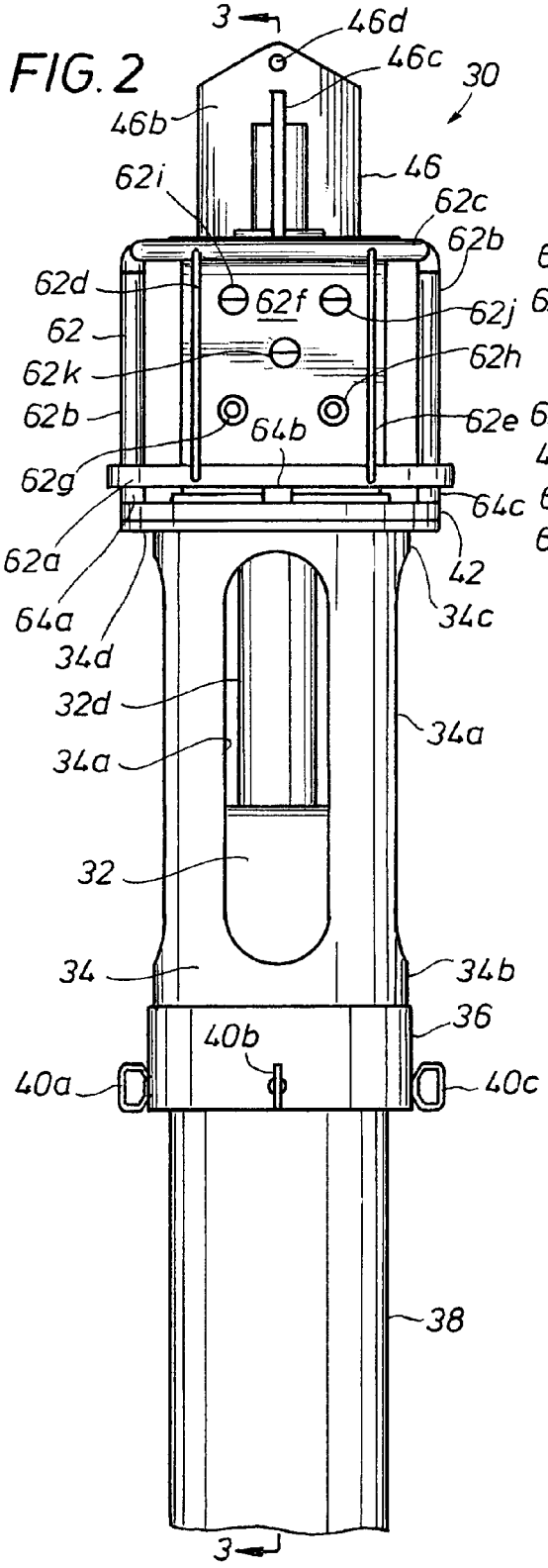
FIG. 2 is a front elevation of a ramming apparatus, according to the present invention.
Figure 3:
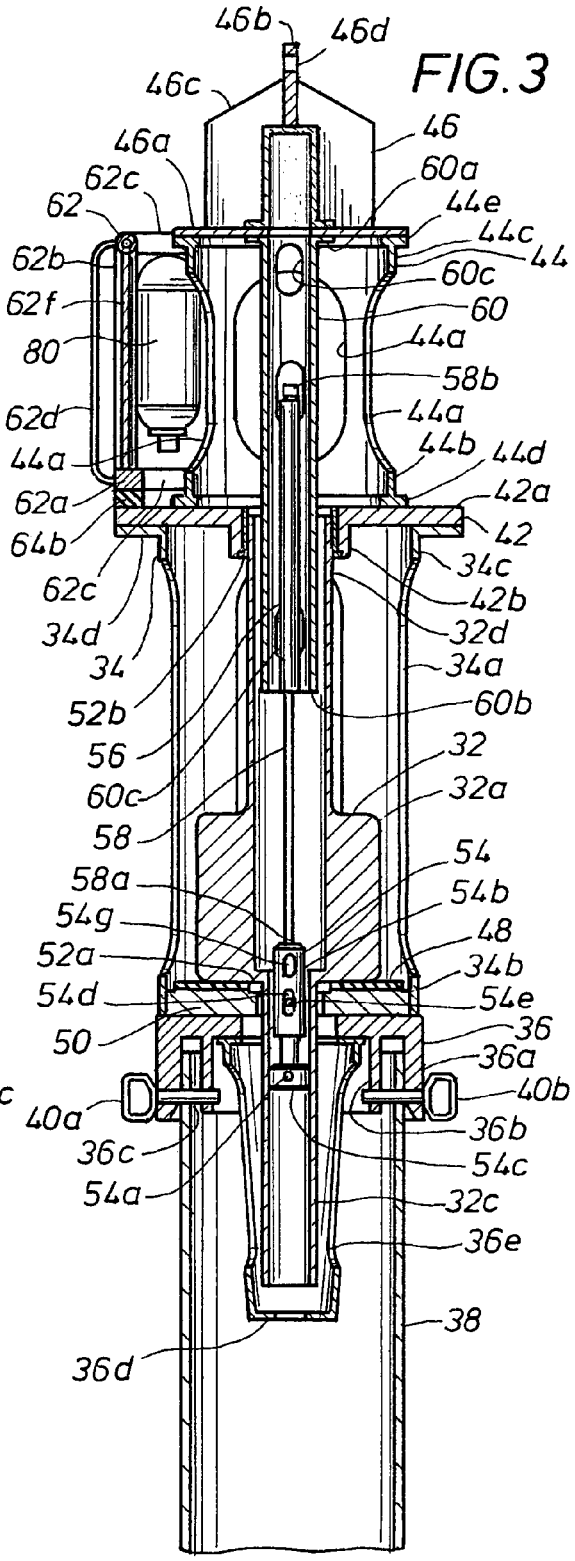
FIG. 3 is a cross-section of the ramming apparatus of FIG. 2 as seen along the line 3-3, except a piston cylinder, a piston rod and a coupling mechanism are not shown in cross-section.

Turning now to FIG. 2, an elevation is shown of a ramming or hammering apparatus 30, according to the present invention. FIG. 3 is a cross-section of ramming apparatus 30 of FIG. 2, as seen along the line 3-3. Ramming apparatus 30 includes a hammer or ram 32, which is a heavy mass of typically a metal material, sometimes referred to as hammer mass or ram mass 32. Ram or hammer 32 is received in a ram frame 34, which has a plurality of openings, one of which is shown as opening 34*a*. Ram 32 has three additional openings like opening 34*a*, which will be referred to collectively as openings 34*a*. Ram frame 34 can be made from a section of pipe having a circular cross-section. Hammer 32 reciprocates while submerged in water since openings 34*a* provide ingress and egress for water when ramming apparatus 30 is operated underwater. Hammer 32 is preferably designed to move as hydrodynamically through water as possible and has rounded corners 32*a* and 32*b*. Ram frame 34 has a lower end 34*b* and an upper end 34*c*. A pile cap or skirt 36 is removeably attached, such as by bolts or temporary welds, to the lower end 34*b* of ram frame 34. Skirt or cap 36 is preferably made removable so that different skirts or caps can be customized for a particular object that is to be driven into subsea soil. A well conductor 38 is the object to be driven into subsea soil in this embodiment. Four pins 40*a*, 40*b*, 40*c* and 40*d* (not shown), collectively referred to as pins 40, are used to removeably connect skirt 36 to well conductor 38. The pins 40 are preferably removable by an ROV. See, for example, U.S. Pat. No. 5,540,523, issued to Foret, Jr. et al. and incorporated by reference, for a description of a pinned connection that can be manipulated by an ROV. Pile cap or skirt 36 has an outer downward extension 36*a* and an inner downward extension 36*b* that is parallel to outer downward extension 36*a*. A gap 36*c* is defined between outer downward extension 36*a* and inner downward extension 36*b*, and a top portion of well conductor 38 is received in gap 36*c*. A downwardly extending guard element 36*d* is attached to a bottom surface of pile cap or skirt 36 and has openings 36*e* for ingress and egress of water. Guard element 36*d* is closed at its lower end and open at its upper end.

Figure 4:
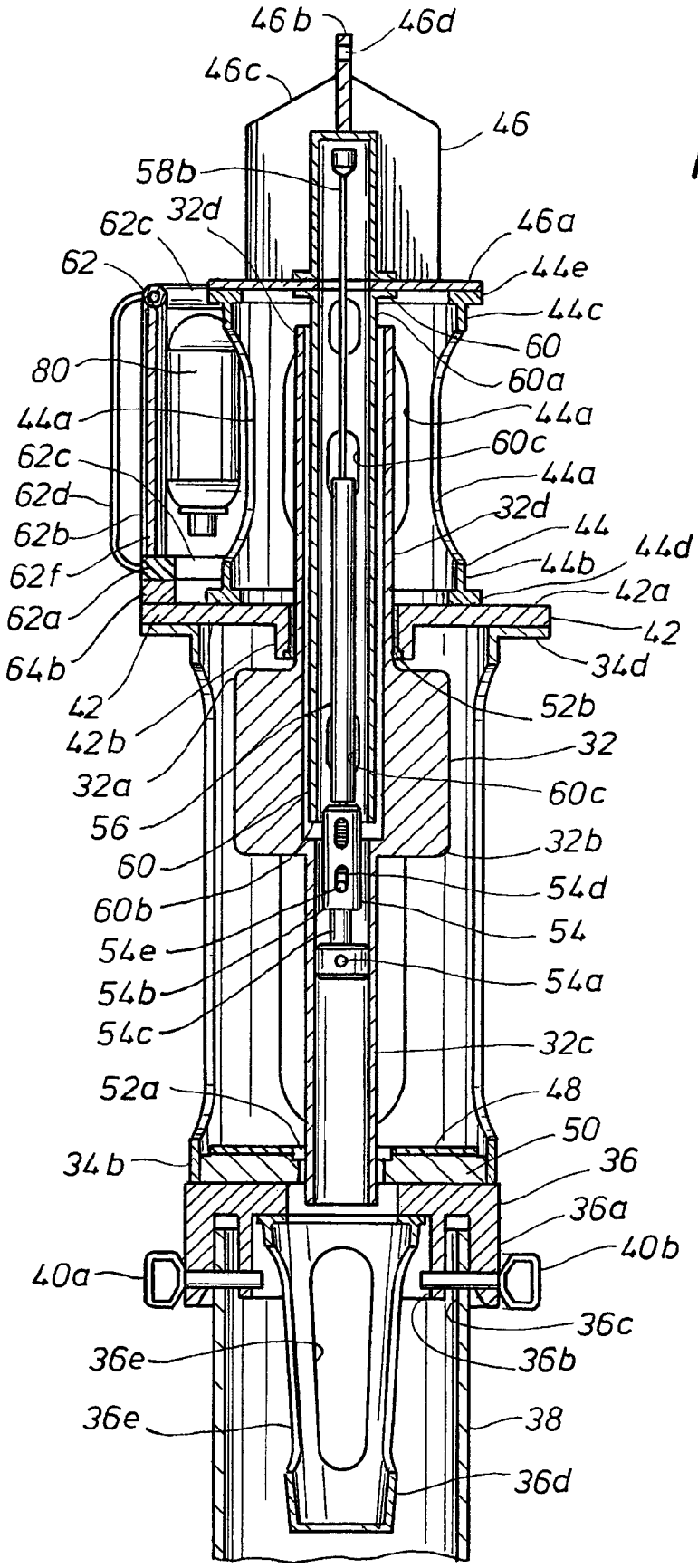
FIG. 4 is the cross-section of FIG. 3, except with the ram in its raised position, according to the present invention.

FIG. 4 is also a cross-section of ramming apparatus 30 of FIG. 2, as seen along the line 3-3, except with ram or hammer 32 in a raised position. With reference to FIGS. 2-4, upper end 34*c* of ram frame 34 terminates in a flange 34*d*. A guide plate 42 is secured to flange 34*d* on upper end 34*c* of ram frame 34. A hydraulics frame 44 is secured to an upper surface 42*a* of guide plate 42 in axial alignment with ram frame 34. Hydraulics frame 44 can be made from a section of pipe having a circular cross-section and has four relatively large openings collectively referred to as 44*a*, which are approximately evenly spaced about the circumference of the hydraulics frame 44. Openings 44*a* allow water ingress and egress, and in operation underwater, the interior of hydraulics frame 44 is filled with water. Hydraulics frame 44 has a lower end 44*b* and an upper end 44*c*. A lower flange 44*d* connects lower end 44*b* to the upper surface 42*a* of guide plate 42, and an upper flange 44*e* is secured to upper end 44*c* of hydraulics frame 44. A hoist cap 46 has a lower flange 46*a* secured to upper flange 44*e* of hydraulics frame 44, and hoist cap 46 can be made from a section of pipe having a circular cross-section, but is shown in this embodiment as two plates 46*b* and 46*c* intersecting at a right angle. Plate 46*b* has an opening 46*d* for receiving a lifting line (not shown).

Figure 7:
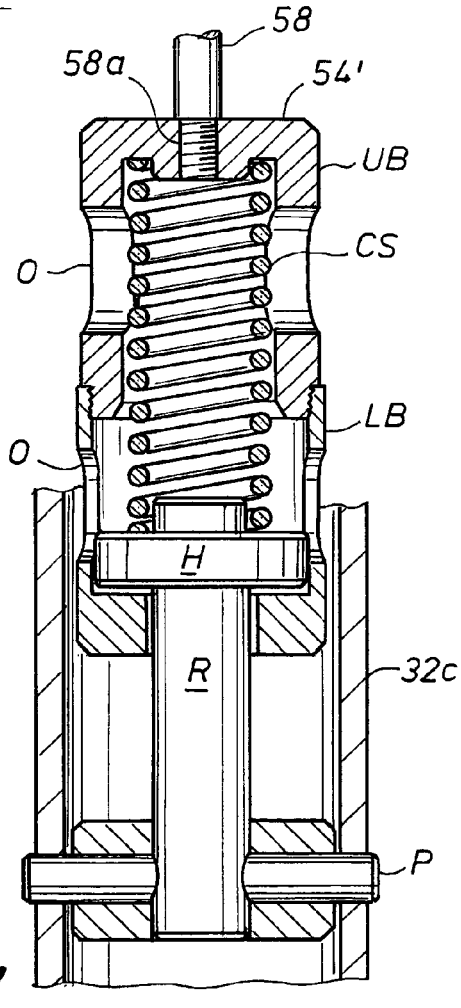
FIG. 7 is an elevation in cross-section of an alternative embodiment of a coupling mechanism.
Figure 5:
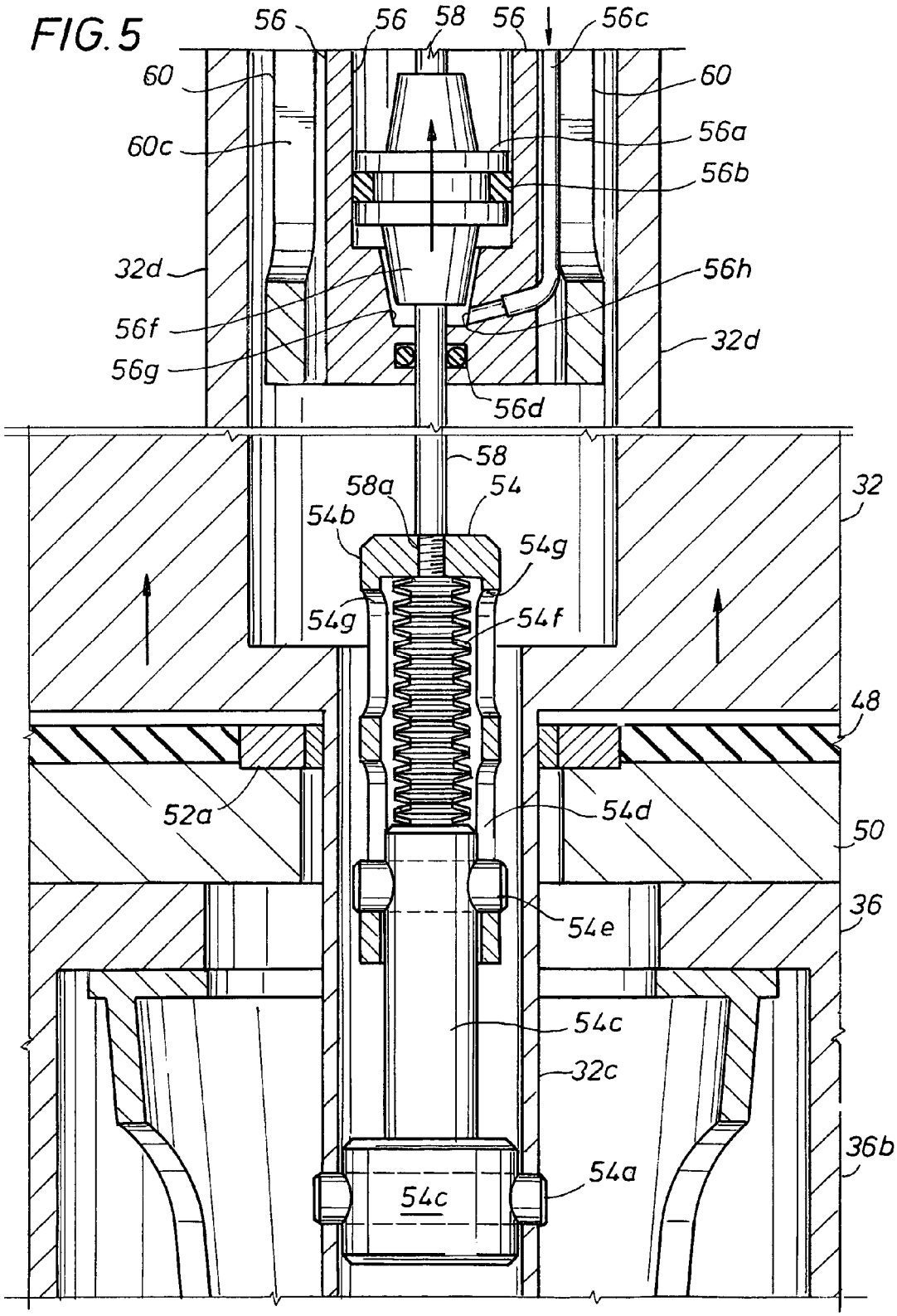
FIG. 5 is a partial cross-section of the ramming apparatus of FIG. 2 as seen along the line 3-3, except rotated 90 degrees, showing the piston cylinder and the coupling mechanism in cross-section, while the ram is being lifted.
Figure 6:
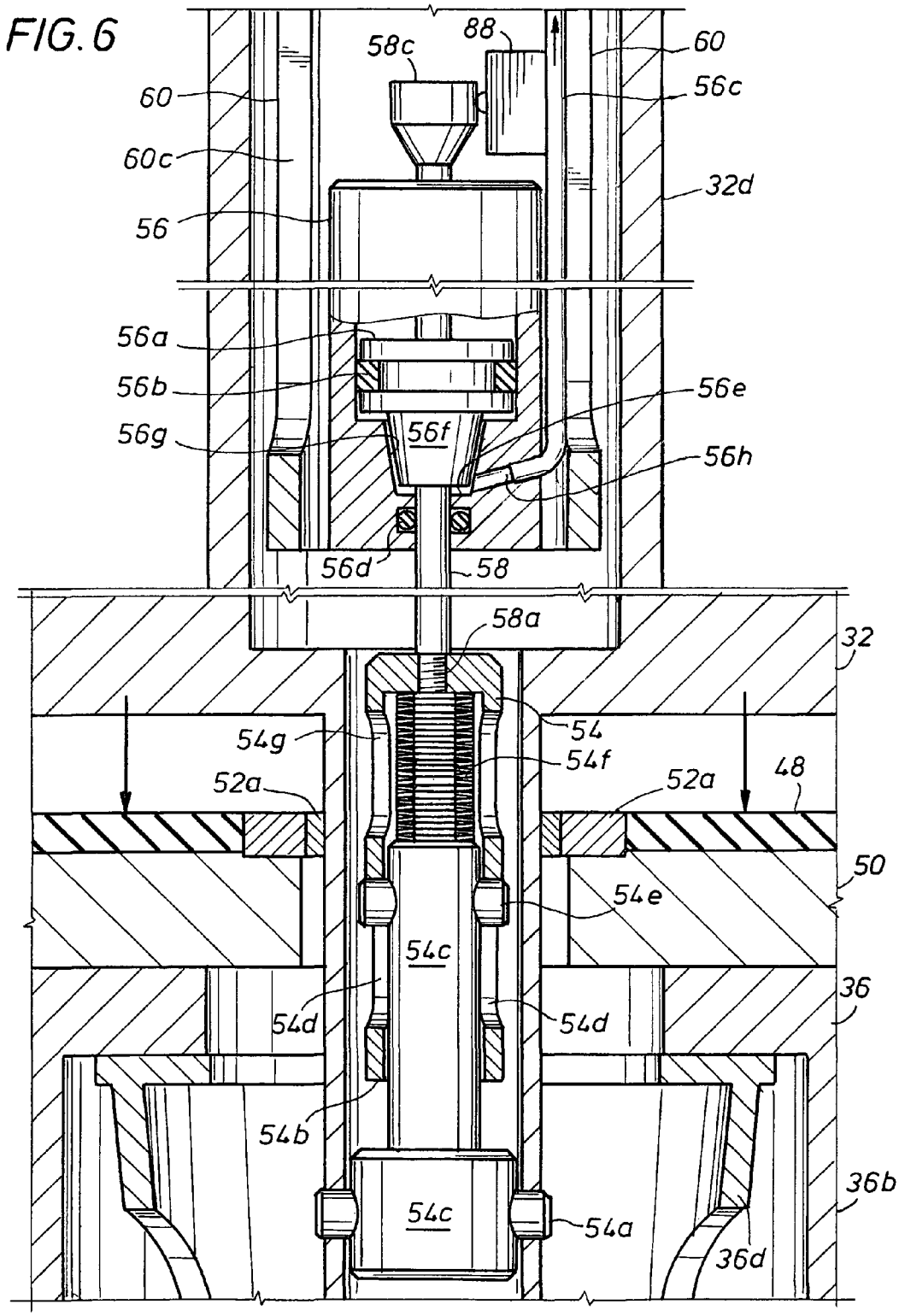
FIG. 6 is the partial cross-section of FIG. 5, except showing the ram as it is pushed downwardly.

As can be seen in FIGS. 3 and 4, when hammer or ram 32 falls, it strikes a cushion 48, which is a firm but resilient material, and the force of the blow passes through cushion 48 to an anvil 50. It is preferred that ram 32 strike cushion 48 rather than strike anvil 50 directly metal-to-metal, although cushion 48 is generally thought of as merely part of anvil 50. The force is transmitted through cushion 48 and anvil 50 to skirt or cap 36 and through skirt or cap 36 to well conductor 38, driving well conductor 38 into the subsea soil. Hammer or ram 32 has a lower ram guide 32*c* and an upper ram guide 32*d* for maintaining ram 32 in axial alignment. Lower ram guide 32*c* is received in and is protected from damage by guard element 36*d*. Lower ram guide 32*c* is received in a lower linear bearing 52*a*, and upper ram guide 32*d* is received in an upper linear bearing 52*b*. Lower linear bearing 52*a* is received in and secured to anvil 50 and cushion 48. Upper linear bearing 52*b* is received in guide plate 42, which has a central opening and a flanged portion 42*b* for receiving and securing upper linear bearing 52*b*. A coupling mechanism or coupler 54, which is explained in greater detail with reference to FIGS. 5-7, is connected by a pin 54*a* to lower ram guide 32*c*. A piston cylinder 56 receives a piston rod 58, which has a lower end 58*a* connected, such as by threads, pin or welding, to coupler 54 and an upper end 58*b*. Piston cylinder 56 is received in and protected by a piston cylinder tube 60, and piston cylinder 56 is secured within piston cylinder tube 60 in some manner such as by bolts or pins (not shown). Piston cylinder tube 60 has a flanged upper end 60*a*, an open lower end 60*b* and a plurality of reasonably large openings 60*c* for ingress and egress of water. Flanged upper end 60*a* is secured, such as by bolting or welding, to lower flange 46*a* of hoist cap 46, and piston cylinder tube 60 should be positioned in vertical axial alignment for properly guiding and lifting ram 32. Piston cylinder 56, piston rod 58 and coupler 54 have not been shown in cross-section for clarity in explaining the construction of ramming or hammering apparatus 30.

Pressurized hydraulic fluid on the underside of a piston is used to raise piston rod 58 and thus lift ram 32, which is explained in further detail below with reference to FIGS. 8 and 9. A hydraulics sub-frame 62 is attached through shock and vibration isolators 64*a*, 64*b* and 64*c* (collectively isolators 64) to guide plate 42 adjacent to hydraulics frame 44. Hydraulics apparatus is mounted to sub-frame 62, and sub-frame 62 protects the hydraulics apparatus from damage. Hydraulics sub-frame 62 includes a base plate 62*a*, which is bolted or otherwise connected to the three (or four or more) shock and vibration isolators 64, which may be an elastomeric material or a coil spring with top and bottom plates. Base plate 62*a* is shown as a bar stock having a rectangular cross-section, but may have an "L" shaped cross-section found in angled stock. A pipe frame having vertical members 62*b* and horizontal members 62*c* is secured to horizontal base plate 62*a*. A top plan view of FIG. 2 is not provided, but would show that horizontal member 62*c* of the pipe frame has a "U" shape in general and is proximate to, but unconnected to, hydraulics frame 44. Hydraulics sub-frame 62 is attached only to shock and vibration isolators 64 so as to minimize the shock and vibration to the hydraulic components that is emitted when ram 32 strikes cushion 48 and anvil 50. ROV manipulator arm grab bars 62*d* and 62*e* provide a structure on hydraulics sub-frame 62 to which an ROV can anchor itself to ramming or hammering apparatus 30. A guard plate 62*f* provides a surface to which hydraulic components can be mounted and protects the hydraulic components from damage.

Coupling Mechanism

As shown in FIGS. 3 and 4, piston rod 58 is connected at its lower end 58*a* to coupler 54, such as by threads or welding. Coupler 54 is connected to lower ram guide 32*c* by pin 54*a*. Coupler 54 comprises a hollow, cylindrical body 54*b*, and a solid rod 54*c* is slideably received inside hollow, cylindrical body 54*b*. Pin 54*a* fastens solid rod 54*c* to lower ram guide 32*c*. Hollow, cylindrical body 54*b* has a pair of opposing slots 54*d*, and a pin 54*e* slideably connects solid rod 54*c* to hollow, cylindrical body 54*b*. As piston rod 58 is lifted upward by hydraulic force, hollow, cylindrical body 54*b* is lifted upward, and pin 54*e* rests rigidly against a lowermost edge of slots 54*d*, causing solid rod 54*c*, through pin 54*a*, to lift lower ram guide 32*c* and ram or hammer 32. After ram 32 reaches its uppermost point, the hydraulic lifting force is stopped, and the hydraulic system is adapted to let ram 32 fall by gravity, and the hydraulic system is adapted to give the ram 32 a downward push through piston rod 58. If piston rod 58 pushed rigidly on ram 32 to the lowermost point of the fall of ram 32, then piston rod 58 would likely buckle, and the entire shock of the hammer-anvil strike would be felt by the more sensitive components of the piston 56. This problem was recognized in, and a solution is disclosed in, U.S. Pat. No. 2,798,363, issued to Hazak et al. and incorporated by reference. To prevent buckling of piston rod 58, as piston rod 58 pushes downwardly on hollow, cylindrical body 54*b*, the downward force is transmitted to solid rod 54*c* through a spring device 54*f*, which is shown in FIGS. 5 and 6. As solid rod 54*c* is pushed downwardly, pin 54*e* slides toward the uppermost point of slots 54*d*, which provides a non-rigid connection between piston rod 58 and hammer or ram 32. However, during the downward push on hammer or ram 32, pin 54*e* may rest against the uppermost edge of slots 54*d*, providing an essentially rigid connection for the initial downward push. The spring device is contained inside hollow, cylindrical body 54*b* and is adapted to push rod 54*c* downwardly. Pin 54*e* is pushed to an intermediate position immediately prior to impact. Hollow, cylindrical body 54*b* has openings 54*g* for ingress and egress of water.

Turning to FIGS. 5 and 6, coupling mechanism 54 of FIGS. 3 and 4 is shown in cross-section and rotated 90 degrees. FIGS. 5 and 6 further show piston cylinder 56 in cross-section. A piston 56*a* is received in piston cylinder 56 and is sealed against an inside wall of piston cylinder 56 by a piston ring 56*b*. FIG. 5 shows hydraulic fluid flowing into a tube 56*c* and into piston cylinder 56 below piston 56*a*, which lifts ram 32 upward. Hydraulic fluid is prevented from leaking out around piston rod 58 by a seal 56*d*. Spring device 54*f*, which can be an elastomeric material, a coil spring or any suitable device such as cupped, Belleville washers as shown in FIGS. 5 and 6, is relaxed as ram 32 is lifted in FIG. 5, and pin 54*e* rests against a bottom edge that defines the lowermost portion of opposing slots 54*d*. In FIG. 6, piston rod 58 has been pushed downwardly, and ram 32 is nearly at its lowermost position on its downward stroke just before hitting cushion 48 and anvil 50. Pin 54*e* has moved to its uppermost position, bearing against an upper edge of opposing slots 54*d*, and spring device 54*f* is essentially fully compressed. Before ram mass 32 strikes cushion 48, pin 54*e* will preferably move away from the upper edge of opposing slots 54*d* as shown in FIG. 3, which is explained below, thus providing an essentially non-rigid connection between piston rod 58 and ram mass 32.

FIG. 7 is a cross-section of an alternate embodiment of a coupling mechanism or coupler 54' that has an upper hollow, cylindrical body UB threaded to lower end 58*a* of piston rod 58 and a lower hollow, cylindrical body LB threaded to a lower end of upper body UB. A rod R has a head H slideably received in lower body LB, and a pin P secures rod R to lower ram guide 32*c*. A coil spring CS pushes against head H, pushing rod R, and thus ram 32, downwardly. As piston rod 58 is lifted, head H rests against a bottom inside surface of lower body LB, and ram mass 32 is lifted through the connection of pin P to lower ram guide 32*c*. When piston rod 58 is initially pushed downwardly, head H moves with respect to lower body LB to rest against an upper inside surface provided by the lower end of upper body UB. Immediately before the end of downward travel of ram mass 32, coil spring CS pushes head H downward away from the lower end of upper body UB. Consequently, at the time that ram mass 32 strikes cushioned anvil 50, head H is in an intermediate position between its upper and lower limits of travel, and is thus providing an essentially non-rigid connection. Upper body UB and lower body LB have openings O for ingress and egress of water. Coupler 54' operates in a manner similar to the operation of coupler 54. The coupling mechanisms 54 and 54' can be said to provide a connection between the piston rod 58 and the ram mass 32 that can move between an essentially rigid lift connection, an essentially rigid downward-push connection and an essentially non-rigid impact connection for preventing buckling of the piston rod and reducing shock transmission to the piston cylinder 56.

Hydraulic Circuit

Figure 8:
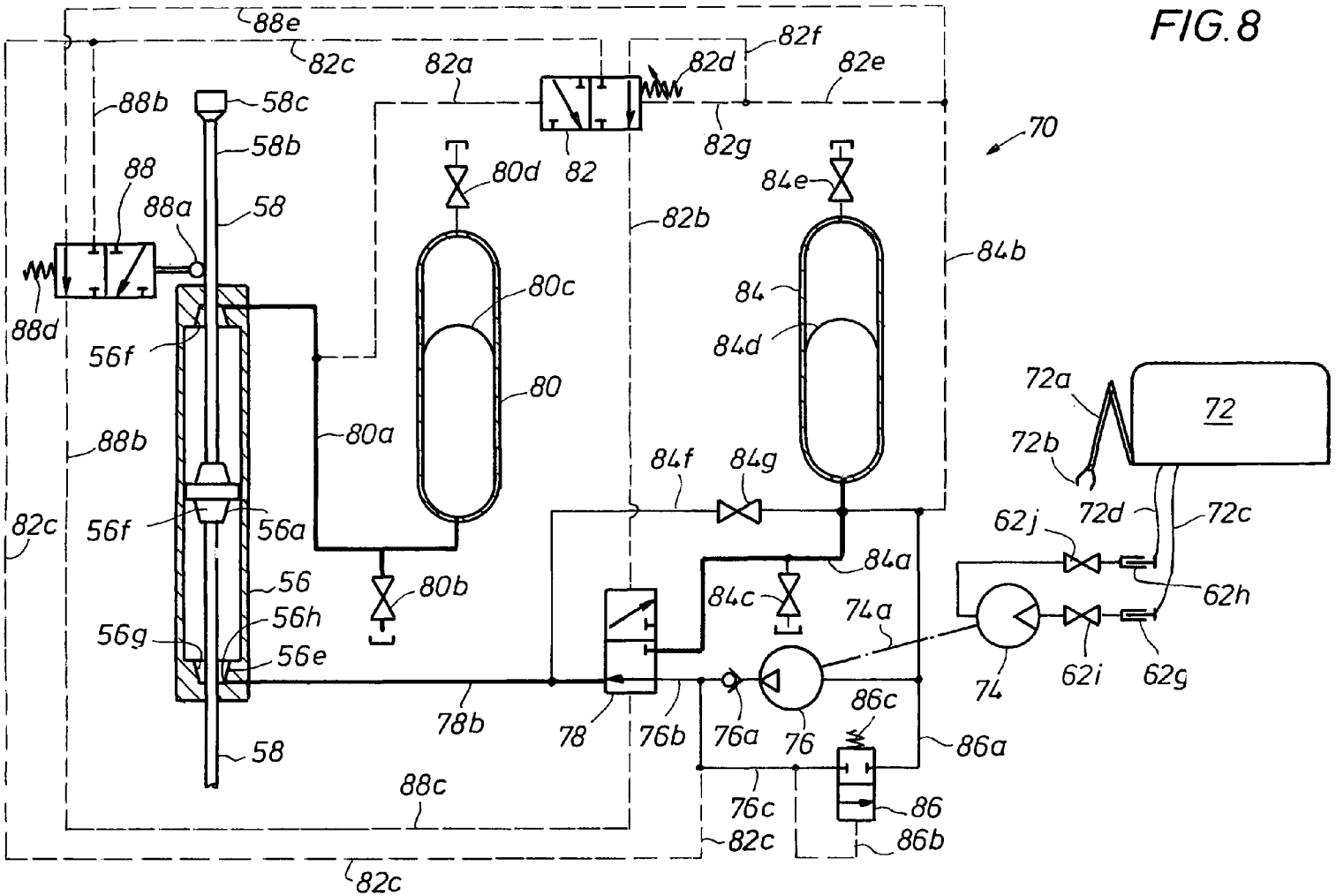
FIG. 8 is a schematic of a hydraulic system for powering the ramming apparatus of FIG. 2, according to the present invention.

Turning to FIG. 8, a hydraulics circuit 70 is illustrated schematically and illustrates one embodiment for powering ramming or hammering apparatus 30 of FIG. 2, according to the present invention. With reference to FIGS. 2 and 8, an ROV 72 has a manipulator arm 72*a* with a manipulator 72*b*. ROV 72 has its own hydraulic system that provides pressurized hydraulic fluid through an out-flowing hose 72*c* and receives the hydraulic fluid from an in-flowing hose 72*d*. ROV 72 attaches itself (via remote control by an operator on the surface) through means not shown to grab bars 62*d* and 62*e* (FIG. 2) and uses manipulator 72*b* to connect out-flowing hose 72*c* to an inlet connector 62*g* on guard plate 62*f* and to connect in-flowing hose 72*d* to an outlet connector 62*h* on guard plate 62*f*. Manipulator 72*b* is then used to open valves 62*i* and 62*j* mounted to guard plate 62*f*. With hoses 72*c* and 72*d* connected and valves 62*i* and 62*j* open, pressurized hydraulic fluid flows out of ROV 72 through out-flowing hose 72*c*, through valve 62*i*, into a hydraulic motor 74, out through valve 62*j*, and returns to ROV 72 through in-flowing hose 72*d*. The hydraulic fluid from ROV 72 turns hydraulic motor 74, which drives a hydraulic pump 76, as indicated by line 74*a*. Hydraulic motor 74 and hydraulic pump 76 are mounted to hydraulics sub-frame 62, but are not shown in FIGS. 2-4. Motor 74 and pump 76 drive a ram-side hydraulic fluid through hydraulic circuit 70, which is mounted to hydraulics sub-frame 62.

The ram-side hydraulic fluid is pumped out of pump 76 through a check valve 76*a* through a line 76*b* to a directional control valve 78. During lift of ram mass 32, fluid flows through directional control valve 78 through a line 78*b* (and tube 56*c* in FIGS. 5 and 6) into a lower end 56*e* of piston cylinder 56. Pressurized fluid fills the volume within piston cylinder 56 below piston 56*a* and raises piston 56*a*, which lifts ram mass 32 through piston rod 58. As piston 56*a* rises, liquid hydraulic fluid flows out of a volume within piston cylinder 56 above piston 56*a* through an opening in an upper end 56*f* of piston cylinder 56 into an accumulator 80 through a line 80*a*. A gaseous fluid is trapped within accumulator 80, which is referred to as tuneable gas spring 80, and the gaseous fluid is pressurized as liquid hydraulic fluid flows into tuneable gas spring 80, storing energy in the gaseous fluid. The energy stored in the gaseous fluid in tuneable gas spring 80 is used to drive the ram mass 32 downward after the top of the stroke is reached. An adjustable head end pressure sensing valve 82 senses the pressure in gas spring 80 through a line 82*a* connected to line 80*a*. When a pre-selected pressure is reached in adjustable head end pressure sensing valve 82, pressure sensing valve 82 shifts, which causes high-pressure hydraulic fluid to flow from pressure sensing valve 82 through a line 82*b* to directional control valve 78. High-pressure hydraulic fluid is obtained from the discharge side of pump 76 through a line 82*c*, which is connected to line 82*b* through pressure sensing valve 82 when pressure sensing valve 82 shifts out of the position shown in FIG. 8. The setting for the pre-selected pressure that causes pressure sensing valve 82 to shift can be changed from the surface through ROV 72 during a ramming operation. The pre-selected pressure controls the height to which the hammer 32 rises, and thus, changing the setting for the pre-selected pressure alters the impact energy with which the hammer 32 strikes the cushion 48 and anvil 50. Being able to reduce the maximum impact energy with which the hammer 32 strikes is important in a pile-driving process, because it allows lower impact energy to be delivered to the pile during the initial phase of driving the pile, allowing the pile to be driven more slowly during this sensitive time. After the pile or other object is driven into soil sufficiently to be stable, the pre-selected pressure can be changed to raise the hammer 32 higher, which will drive the pile 38 more forcefully.

As high-pressure hydraulic fluid flows from pressure sensing valve 82 through line 82*b* to directional control valve 78, directional control valve 78 shifts out of the position shown in FIG. 8, which allows hydraulic fluid in piston cylinder 56 under piston 56*a* to quickly discharge into a low-pressure bladder 84 through a line 84*a*. The flow of hydraulic fluid from pump 76 into directional control valve 78 through line 76*b* is stopped while the fluid under piston 56*a* discharges to low-pressure bladder 84, and the flow from pump 76 is instead directed through a line 76*c* to low-pressure bladder 84 through a relief valve 86 and a line 86*a*. As the pressure in line 76*c* increases, the pressure is sensed in relief valve 86 through a line 86*b*, and when the pressure in line 86*b* is high enough to overcome a bias provided by a spring 86*c*, relief valve 86 shifts out of the position shown in FIG. 8, allowing hydraulic fluid to flow through lines 76*c* and 86*a* to low-pressure bladder 84.

Energy stored in the gas in the tuneable gas spring 80 forces the hydraulic fluid in line 80*a* to reverse its flow direction, and fluid in tuneable gas spring 80 flows through line 80*a* into piston cylinder 56 above piston 56*a*, which provides a downward pushing force on piston 56*a* then through piston rod 58 to ram mass 32 through coupler 54 (FIGS. 5 and 6). Thus, the downward force on ram mass 32 is a combination of the force due to gravity and the force from the release of energy stored in the gas in the tuneable gas spring 80 during the lift stroke. Piston 56*a* is pushed forcefully downwardly as stored energy is released from tuneable gas spring 80 in the down stroke. To prevent piston 56*a* from slamming into the bottom of piston cylinder 56 and to prevent piston rod 58 from buckling as ram mass 32 slams into cushion 48 and anvil 50, piston 56*a* is adapted with a frustoconical-shaped downward projection 56*f* that is matingly received by a frustoconical-shaped recess 56*g*. Piston 56*a* and piston cylinder 56 can have other shapes that accomplish the same purpose. A port 56*h*, which receives tube 56*c*, which receives line 78*b* (FIGS. 5, 6 and 8), is located in the side wall of piston cylinder 56 at the lower end of frustoconical-shaped recess 56*g*. Frustoconical-shaped downward projection 56*f*, frustoconical-shaped recess 56*g* and port 56*h* should be designed to decelerate piston 56*a* and piston rod 58 near the end of the down stroke such that downward projection 56*f* begins to restrict the flow of hydraulic fluid out of the lower end 56*e* of piston cylinder 56 as downward projection 56*f* nears the lowermost end of piston cylinder 56. As the flow of hydraulic fluid out of lower end 56*e* is restricted, the downward speed of piston 56*a* is necessarily slowed, which prevents piston 56*a* from slamming into lower end 56*e* of piston cylinder 56. With reference to FIG. 6, as piston 56*a* slows near the end of its down stroke, spring device 54*f* expands, which moves pin 54*e* into an intermediate position in opposing slots 54*d*, as shown in FIG. 3, so that pin 54*e* is preferably not pressed against the upper edge of slots 54*d* at the time ram mass 32 strikes cushion 48 and anvil 50. For the up stroke, piston 56*a* has an upward projection that is similarly received in a recess in the upper end of piston cylinder 56, and a port is similarly located so that flow is restricted near the end of the up stroke to prevent piston 56*a* from slamming into the upper end of piston cylinder 56 at the end of the up stroke.

FIG. 8 shows a lowermost position sensing valve 88 and a cam follower 88*a* for detecting and limiting the lowermost position of piston rod 58, and upper end 58*b* of piston rod 58 has a cam 58*c* at the uppermost end of piston rod 58. After piston rod 58 has been decelerated and downward projection 56*f* has essentially reached the bottom of its mating recess 56*g*, cam 58*c* on the upper end of piston rod 58 moves cam follower 88*a* (FIG. 6), which shifts the position of lowermost position sensing valve 88, causing high-pressure hydraulic fluid from pump 76 to flow through a line 88*b* into a line 88*c* to directional control valve 78, which causes directional control valve 78 to shift back to the position shown in FIG. 8, allowing pump 76 to again pump fluid through directional control valve 78 and line 78*b* for another lift stroke. As cam 58*c* is lifted due to the flow of hydraulic fluid into the lower end 56*e* of piston cylinder 56, a spring 88*d* shifts the position of lowermost position sensing valve 88 back to the position shown in FIG. 8. With lowermost position sensing valve shifted back into the position shown in FIG. 8, a low-pressure signal from low-pressure bladder 84 is placed on directional control valve 78 through lines 88*e* and 88*c*, and allowing a low-pressure signal from low-pressure bladder 84 through a line 88*e* passes through lowermost position sensing valve 88 into line 88*c* to provide a low-pressure signal to directional control valve 78 from line 88*c*.

During the down stroke, pressure was released from tuneable gas spring 80, and the lower pressure was detected through line 82*a* in adjustable head end pressure sensing valve 82, allowing spring 82*d* to shift pressure sensing valve 82 back to the position shown in FIG. 8 and allowing a low-pressure signal from low-pressure bladder 84 to pass through pressure sensing valve 82 to line 82*b* and to directional control valve 78 through a line 82*e* and a line 82*f*. A line 82*g* maintains a low-pressure signal on pressure sensing valve 82. Low-pressure bladder 84 has a line 84*b* that connects to lines 82*e* and 88*e* for delivering a low-pressure supply from low-pressure bladder 84 to each side of directional control valve 78 so that directional control valve 78 does not move except when shifted due to a momentary high-pressure signal delivered through either line 82*b* or line 88*c*. The up stroke was described above, and when the pressure builds in line 82*a* to the pre-selected value, adjustable head end pressure sensing valve 82 shifts out of the position shown in FIG. 8, which puts a high-pressure signal on the upper end of directional control valve 78 from pump 76 through lines 82*c* and 82*b*, shifting the position of directional control valve 78 out of the position shown in FIG. 8 and allowing the hydraulic fluid under piston 56*a* to dump to low-pressure bladder 84.

The pressure setpoint for shifting the position of adjustable head end pressure sensing valve 82 can be changed and set by rotation of an adjustment screw that changes and sets the force exerted by spring 82*d*. A mechanical linkage (not shown) is provided between the adjustment screw for spring 82*d* and a T-handled operator 62*k* located on guard plate 62*f* so that ROV 72 and its manipulator 72*b* can be used to change and set the pressure setpoint for shifting the position of adjustable head end pressure sensing valve 82. Changing the pressure setpoint changes the height to which ram mass 32 is lifted and thus the force of impact after ram 32 is dropped. This allows the impact force to be changed during an object-driving process, such as a pile driving process, for purposes such as starting with light taps and ending with heavy blows.

Hydraulic fluid can be charged to and removed from low-pressure bladder 84 and the lower end 56*e* of piston cylinder 56 by a valve 84*c*. Hydraulic fluid can be charged to and removed from tuneable gas spring 80 and the upper end of piston cylinder 56 by a valve 80*b*. Tuneable gas spring 80 has a bladder membrane 80*c* inside, and gas can be charged to the upper end of tuneable gas spring 80, above the bladder membrane 80*c*, through a valve 80*d*. The pressure inside tuneable gas spring 80 is preferably higher than the anticipated pressure of water on the outside of tuneable gas spring 80, which will depend on the depth of operation of ramming apparatus 30. Low-pressure bladder 84 has a bladder membrane 84*d*, and a charging valve 84*e* is provided for charging a fluid into low-pressure bladder 84 above bladder membrane 84*d*. Charging valve 84*e* can be used to charge water into low-pressure bladder 84 above bladder membrane 84*d* and then left open for pressure compensation as low-pressure bladder 84 is lowered into deep water. A manual bypass line 84*f* and a valve 84*g*, which is normally closed, can be used to release pressure in the lower end 56*e* of the piston cylinder 56 by draining hydraulic fluid through line 84*f* into low-pressure bladder 84. Various adjustments should be made to the hydraulic circuit prior to deploying the ramming apparatus in order to set or tune the ramming apparatus for operation in a particular depth of water and for an initial lift height of the hammer mass. In particular, tuneable gas spring 80, low-pressure bladder 84, pressure sensing valve 82 and the adjustment screw for spring 82*d* should be checked prior to deployment.

Alternative Hydraulic Circuit

Figure 9:
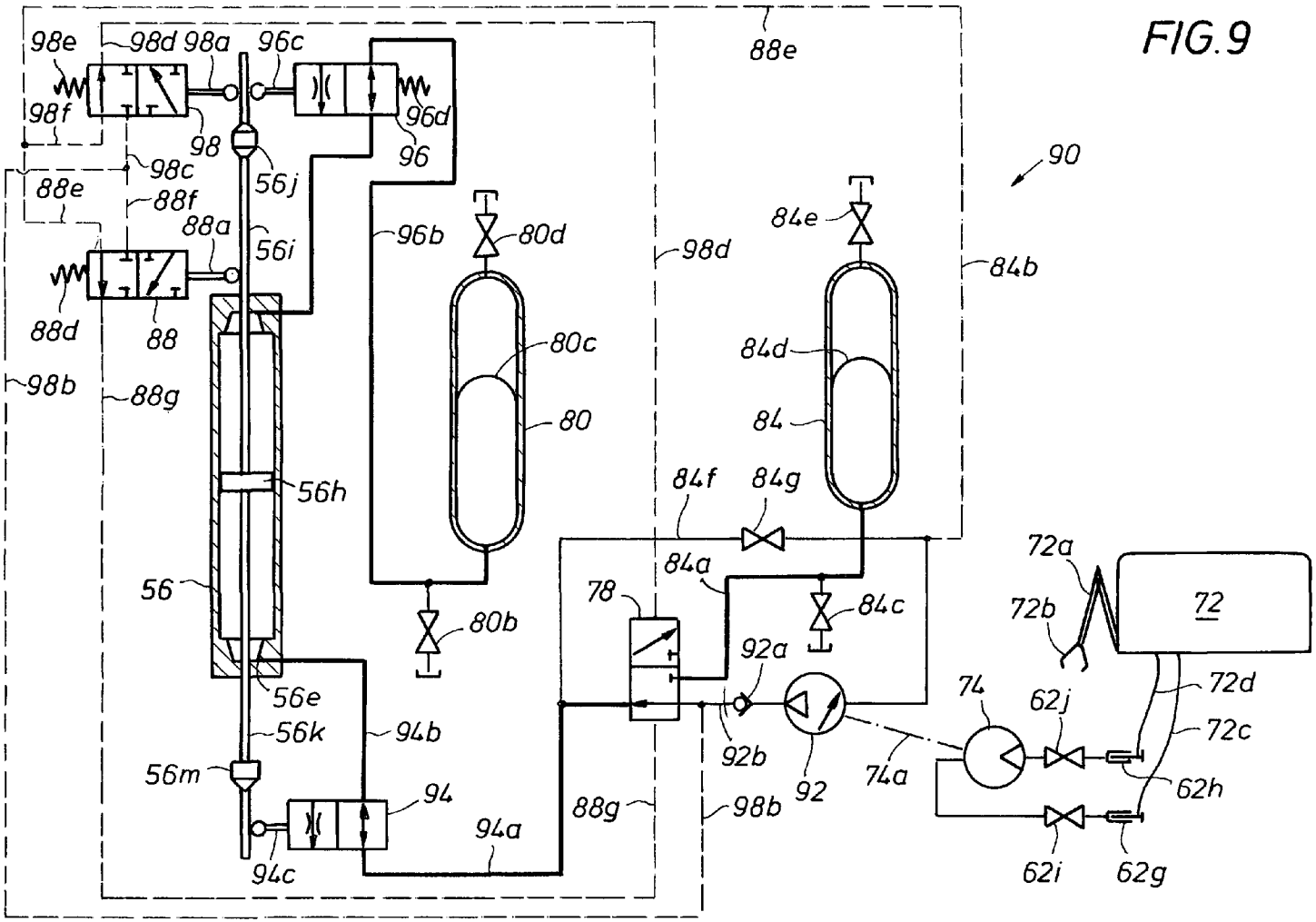
FIG. 9 is a schematic of an alternative embodiment of a hydraulic system for powering the ramming apparatus of FIG. 2, according to the present invention.

FIG. 9 shows an alternative hydraulic circuit 90 that includes a number of the same components as in FIG. 8, which are given the same element number as in FIG. 8, and a number of different components, which are given new element numbers. ROV 72 connects as described with reference to FIG. 8 to motor 74 in FIG. 9, which connects as indicated by line 74*a* to a pressure-compensated variable displacement pump 92, which replaces both pump 76 and relief valve 86 of FIG. 8. The flow from pump 92 automatically regulates itself depending on the back-pressure on its discharge side, which depends on whether hydraulic fluid is flowing through a check valve 92*a*, a line 92*b* and through the directional control valve 78 that was described with reference to FIG. 8. In the embodiment of FIG. 9, hydraulic fluid is pumped from the discharge side of pump 92 through directional control valve 78 to a lower-end deceleration valve 94 through a line 94*a* and on to lower end 56*e* of piston cylinder 56 through a line 94*b*. A different piston 56*h* is used in this embodiment because a different method is used to prevent the piston from slamming into the lower and upper inside ends of piston cylinder 56. As fluid is pumped into piston cylinder 56 under piston 56*h*, piston 56*h* is raised, which lifts ram mass 32, and hydraulic fluid is displaced from piston cylinder 56 from above piston 56*h*. Hydraulic fluid displaced from piston cylinder 56 flows to an upper-end deceleration valve 96 through a line 96*a* and on to tuneable gas spring 80 through a line 96*b*.

An upper piston rod 56*i* is received in piston cylinder 56 and attached to an upper side of piston 56*h*. Upper piston rod 56*i* is fitted with an upper cam 56*j*. Upper-end deceleration valve 96 has a cam follower 96*c* that is moved by upper cam 56*j*, and as piston 56*h* nears the end of its up-stroke, upper cam 56*j* moves cam follower 96*c*, shifting upper-end deceleration valve 96 out of the position shown in FIG. 9 so that hydraulic fluid displaced from the upper end of piston cylinder 56 is passed through an orifice in upper-end deceleration valve 96 before flowing to tuneable gas spring 80, which slows the linear movement of piston 56*h* and prevents piston 56*h* from slamming hard into the upper end of piston cylinder 56. An uppermost position sensing valve 98 detects and controls or limits the uppermost extent of the stroke for upper piston rod 56*i*. Uppermost position sensing valve 98 has a cam follower 98*a* that is located slightly higher than cam follower 96*c* on upper-end deceleration valve 96. As upper cam 56*j* rises immediately after engaging cam follower 96*c*, upper cam 56*j* moves cam follower 98*a*, causing uppermost position sensing valve 98 to shift out of the position shown in FIG. 9, which allows high-pressure hydraulic fluid to flow from pump 92 through a line 98*b* and a line 98*c* through uppermost position sensing valve 98 and through a line 98*d* to directional control valve 78. While cam follower 98*a* is moved out of the position shown in FIG. 9, high-pressure hydraulic fluid flows through lines 98*b* and 98*d*, which shifts directional control valve 78 out of the position shown in FIG. 9, initiating a down stroke as hydraulic fluid quickly flows out of piston cylinder 56 from under piston 56*h* through lower-end deceleration valve 94, through lines 94*a* and 94*b*, through directional control valve 78, and through line 84*a* to low-pressure bladder 84. As hydraulic fluid discharges from under piston 56*h*, upper piston rod 56*i* moves downward, and a spring 96*d* returns upper-end deceleration valve 96 to the position shown in FIG. 9, which allows a downward force on the upper side of piston 56*h* as gas trapped in tuneable gas spring 80, which was compressed during the up-stroke, expands and forces hydraulic fluid out of tuneable gas spring 80 through lines 96*b* and 96*a*. The expansion of the gas that was compressed in tuneable gas spring 80 during the up-stroke provides a downward push during the down-stroke so that ram mass 32 is accelerated downward due to this push and due to the force of gravity. A spring 98*e* returns uppermost position sensing valve 98 to the position shown in FIG. 9 during the down-stroke of piston 56*h*, which allows a low pressure supply signal from low-pressure bladder 84 through lines 84*b* and 88*e* and a line 98*f* through uppermost position sensing valve 98 through line 98*d* to directional control valve 78. This readies directional control valve 78 to shift out of the position shown in FIG. 9 at the top of the up-stroke, when a high-pressure supply signal from line 98*b* will flow through line 98*d* to shift directional control valve 78 out of the position shown in FIG. 9.

A lower piston rod 56*k* is received in piston cylinder 56, attached to the underside of piston 56*h*, and extends out the bottom of piston cylinder 56 through a sealed opening. As piston 56*h* nears the bottom of its stroke, a lower cam 56*m* fitted to lower piston rod 56*k* contacts a cam follower 94*c* in lower-end deceleration valve 94, which shifts lower-end deceleration valve 94 out of the position shown in FIG. 9 so that hydraulic fluid flows out of the lower end of piston cylinder 56 through an orifice in lower-end deceleration valve 94, slowing or decelerating piston 56*h* so that piston 56*h* does not slam hard into the lower end of piston cylinder 56. Immediately after slowing the downward stroke of piston 56*h* by engagement of lower cam 56*m* with cam follower 94*c*, lowermost position sensing valve 88 is shifted out of the position shown in FIG. 9 as cam follower 88*a* is moved by upper cam 56*j*. While lowermost position sensing valve 88 is shifted out of the position shown in FIG. 9, a high pressure supply signal flows through line 98*b* through a line 88*f* through lowermost position sensing valve 88 and through a line 88*g* to directional control valve 78, which shifts directional control valve 78 back into the position shown in FIG. 9 and starts the up-stroke over again. As high pressure hydraulic fluid flows from pump 92 through lines 94*a* and 94*b* into the lower portion of piston cylinder 56 and raises piston 56*h* and upper cam 56*j*, spring 88*d* returns lowermost position sensing valve 88 to the position shown in FIG. 9, allowing a low-pressure supply signal to flow from low-pressure bladder 84 through lines 84*b*, 88*e* and 88*g* to directional control valve 78 so that directional control valve 78 is ready to be shifted out of the position shown in FIG. 9 when the top of the up-stroke is reached again, and a high-pressure signal flows from line 98*b* through uppermost position sensing valve 98 and through line 98*d* to directional control valve 78.

Upper-end deceleration valve 96 and uppermost position sensing valve 98 are preferably mounted on a common plate that can be moved closer to and farther from the top end of piston cylinder 56 by manipulator 72*b* on ROV 72. A gear and/or screw mechanism can be provided, along with a suitable linkage and a connector, which can be manipulated by ROV 72 to adjust the height of the up-stroke in order to adjust the impact force that the hammer mass 32 has on the cushion 48 and anvil 50 and consequently on well conductor 38. Lower-end deceleration valve 94 may be located adjacent to lowermost position sensing valve 88 for convenience. Other hydraulic circuits can be used to lift and drop (and preferably push downward) ram mass 32, and modifications can be made to the embodiments described, while still achieving the objectives of the present invention. Hydraulic components can be purchased from companies such as Eaton Hydraulics Company of Eden Prairie, Minn., USA and Sun Hydraulics Company of Sarasota, Fla., USA.

Operation of the Hammering System

One application for the ramming apparatus of the present invention is driving piles into subsea soil in very deep water, such as for the oil and gas industry. With reference to FIGS. 1 and 2, in this application, piles can be loaded on ship 16 and delivered to the water surface above the work site on the seabed. The piles 18 can have any shape as a cross-section, but are typically circular in cross-section. A pile cap, named thusly because it fits on the top of the pile, or skirt 36, named thusly because it fits on the bottom of the ramming apparatus 30, is selected for this particular pile-driving application for proper shape and size. The selected skirt 36 is fastened to the bottom end 34*b* of ram frame 34. On the deck of the ship 16, skirt 36, which is part of ramming apparatus 30, is attached to an end of pile 18. Lifting line 14 is connected opening 46*d* in hoist cap 46, and crane 16*c* is used to lift ramming apparatus 30 and pile 18 off the ship's deck and to lower the pile 18 through the water to the desired point for driving the pile 18 into the subsea soil S. ROV 20 is stored in its lifting cage 22 on the deck of ship 16, and crane 16*f* is used to lift lifting cage 22 and ROV 20 off the ship 16 and to lower cage 22 and ROV 20 through the water. After it is lowered through the water, ROV 20 can be used by an operator on ship 16 to visually observe through a camera the bottom end of pile 18, and ROV 20 can be used to move the bottom end of pile 18 a little to get pile 18 into the desired spot where it is to be driven. Sound and echo technology can be used to get ship 16 located properly over the spot where pile 18 is to be driven.

With the bottom end of pile 18 located at the desired spot on the seabed and with reference to FIGS. 1, 2 and 8, manipulator 72*b* on ROV 72 (FIG. 8) is used to connect hydraulic hoses 72*c* and 72*d* to connectors 62*g* and 62*h* on hydraulics sub-frame 62 on ramming apparatus 30 (FIG. 2). The initial height for the lift stroke for ram mass 32 is preferably set while ramming apparatus 30 is on the deck of the ship 16 by adjusting the setting for spring 82*d* on adjustable head end pressure sensing valve 82 (FIG. 8) or by adjusting the position of uppermost position sensing valve 98 (FIG. 9). The pile driving operation is preferably begun with relatively light taps from ram mass 32, due to ram mass 32 not being lifted as high as possible but rather to some intermediate height within ram frame 34 (FIG. 2). A nail is driven into wood by initially hitting the nail's head lightly with a hammer followed by heavy blows, and pile 18 is driven into subsea soil S in a similar manner. After pile 18 has been driven in far enough to be stable or after no progress is being made, the setting for spring 82*d* on adjustable head end pressure sensing valve 82 (FIG. 8) or the position of uppermost position sensing valve 98 (FIG. 9) is changed to increase the height to which ram mass 32 is raised for heavier blows on the top of pile 18 for greater driving force. T-handled operator 62*k* on hydraulics sub-frame 62 (FIG. 2) illustrates how the ROV may be used to adjust the height to which the ram 32 may be raised, as T-handled operator 62*k* can be mechanically linked to either pressure sensing valve 82 of FIG. 8 or to position sensing valve 98 of FIG. 9, and of course, there are other means for implementing the present invention.

With the ramming apparatus 30 re-adjusted for hammering with heavier blows, the pile driving process is continued until pile 18 is driven to a desired depth. The descriptions above with reference to FIGS. 8 and 9 provide the details for the reciprocation of the ram 32, but more simply, the ram mass 32 is lifted by pumping hydraulic fluid into piston cylinder 56 under the piston therein to lift ram mass 32 to a desired height. The text above for FIGS. 8 and 9 describes two embodiments of hydraulic circuits for lifting the ram mass and letting it fall, along with a downward push. Pressure in the upper portion of the piston cylinder 56 is monitored in FIG. 8 and used as a proxy for the maximum lift height for ram mass 32, and the position of upper cam 56*j* on piston rod 56*i* is used as a proxy in FIG. 9 for the maximum lift height for ram mass 32. At the desired lift height, which is the top of the lift stroke, directional control valve 78 (FIGS. 8 and 9) is shifted so that hydraulic fluid quickly dumps out from under the piston in piston cylinder 56 into low-pressure bladder 84. The quick release of hydraulic fluid from under the piston allows ram mass 32 to fall by gravity through the surrounding water, striking cushion 48 and anvil 50 to impart a driving force through skirt 36 to the top of the object that is being driven into the soil.

However, an additional force is applied to ram mass 32 because as ram mass 32 is lifted, the hydraulic fluid from above the piston in piston cylinder 56 is displaced into tuneable gas spring 80. Tuneable gas spring 80 is separated by bladder membrane 80*c* (FIGS. 8 and 9) into a lower compartment that receives the displaced hydraulic fluid and an upper compartment that contains a gas such as nitrogen. The gas is compressed during the lift stroke as hydraulic fluid is displaced from above the piston in piston cylinder 56 into the lower compartment in tuneable gas spring 80. Gas spring 80 is referred to as tuneable because the air pre-charge pressure can be adjusted for different water depths and also to give greater or lesser starting and maximum pressures (forces). The maximum height of the ram mass 32 can be adjusted, which changes the pressure to which the gas is compressed in the upper compartment of gas spring 80 as bladder membrane 80*c* moves and reduces the volume of the upper compartment in gas spring 80, and this changes the amount of energy that can be stored in the gas as it is compressed during the up-stroke. In operation, in the down-stroke, immediately after directional control valve 78 is shifted and hydraulic fluid begins dumping from under the piston into the low-pressure bladder 84, hydraulic fluid flows from tuneable gas spring 80 into piston cylinder 56 above the piston therein, and the compressed gas expands against the bladder membrane 80*c*, maintaining a pressure on the hydraulic fluid above the piston in piston cylinder 56, which provides a downward pushing force on the piston and consequently on the piston rod and on ram mass 32 through either coupler 54 (FIGS. 5 and 6) or coupler 54' (FIG. 7). The force of the impact of ram mass 32 on cushion 48 and anvil 50, which is transmitted to the top of pile 18 for driving pile 18 into the soil, is thus a combination of the force due to gravity as ram mass 32 falls freely through the water and the downward push provided by the expanding gas in the tuneable gas spring 80.

When ram mass 32 slams into cushion 48 at the end of the down-stroke, there is a great deal of shock and vibration and possibly a small bounce upward for ram mass 32. Piston rod 58 (FIG. 3) is quite slender compared to the mass of ram 32 and would buckle if it were rigidly connected to ram mass 32 when ram 32 impacts cushion 48. Two embodiments of a non-rigid coupling mechanism have been described above, coupler 54 in FIGS. 3-6 and coupler 54' in FIG. 7. The present invention calls for a coupling mechanism that allows the piston rod to lift ram mass 32 during the up-stroke and to push ram mass 32 during the down-stroke, but not be rigidly connected to ram mass 32 upon impact at the bottom of the down-stroke. In the embodiments described above with reference to FIGS. 3-7, ram mass 32 has lower and upper ram guides 32*c* and 32*d*, which extend downwardly and upwardly from the bulk of ram mass 32, respectively, for guiding and keeping ram mass 32 in vertical, axial alignment with piston cylinder 56 and piston rod 58. With reference to FIG. 5, piston rod 58 is connected to the upper end of coupler 54, and the lower end of coupler 54 is pinned to lower ram guide 32*c*. The upper end of coupler 54 comprises hollow, cylindrical body 54*b*, to which the piston rod 58 connects. The lower end of coupler 54 comprises rod 54*c*, which is slideably received in upper body 54*b*, and pin 54*a* secures rod 54*c* to lower ram guide 32*c*. Upper body 54*b* has a pair of vertical, axially-elongated slots 54*d*, and pin 54*e* slideably connects the upper end of rod 54*c* to the lower end of body 54*a* through engagement of pin 54*e* with the wall that defines opposing slots 54*d*.

Continuing to reference FIG. 5, during the up-stroke, pin 54*e* rests against the bottom of the wall that defines opposing slots 54*d*, providing an essentially rigid connection for piston rod 58 to lift ram mass 32. At the beginning of the down-stroke, compressed gas in tuneable gas spring 80 (FIGS. 8 and 9), pushes piston rod 58 downward faster than the free-falling ram mass 32, and upper body 54*b* of coupler 54 moves downwardly faster than rod 54*c* attached to ram guide 32*c* until pin 54*e* slides to the uppermost edge of the wall that defines opposing slots 54*d* in upper body 54*b*. This sliding of pin 54*e* in slots 54*d* happens quickly, and during most of the down-stroke, pin 54*e* is engaged with the upper edge of slots 54*d*, which provides an essentially rigid connection during much of the down-stroke. However, near the bottom of the down-stroke, piston rod 58 is slowed down or decelerated to a speed slower than the speed at which ram mass 32 is traveling downward. In FIG. 8, deceleration is accomplished using downward frustoconical projection 56*f* that restricts flow of hydraulic fluid out through port 56*e* by gradually covering port 56*e*, thus reducing the cross-section of the flow path through port 56*e*, which slows the downward movement of piston rod 58. In FIG. 9, deceleration is accomplished using lower-end deceleration valve 94, which switches to a port having an orifice to restrict flow out of the bottom of piston cylinder 56 to slow piston rod 58 down. FIGS. 5 and 6 show coupler 54 has spring device 54*f* for pushing rod 54*c* downward so that normally pin 54*e* rests against the bottom edge of opposing slots 54*d*. During most of the down-stroke, spring device 54*f* is compressed as shown in FIG. 6 and pin 54*e* is pressed against the upper edge of slots 54*d*. However, near the bottom of the down-stroke, after piston rod 58 is decelerated, spring device 54*f* expands toward its normal state and pushes pin 54*e* away from the upper edge of slots 54*d* to an intermediate position such as shown in FIG. 3, which provides an essentially non-rigid connection upon impact of ram 32 with cushioned anvil 50. When ram mass 32 slams into cushion 48, pin 54*e* is in an intermediate position between the upper and lower edges that define slots 54*d*, so the shock and vibration of the impact of the blow and the possible bounce of ram mass 32 is not transmitted directly to piston rod 58, instead allowing some movement of rod 54*c* without moving upper body 54*b* or piston rod 58. In this manner, coupler 54 serves to prevent piston rod 58 from buckling when ram mass 32 slams into cushion 48 and anvil 50.

Ram mass 32 is reciprocated through as many up-stroke and down-stroke cycles as necessary to drive pile 18 into the desired depth in subsea soil S. After pile 18 is driven to a desired depth, pins 40*a*, 40*b*, 40*c* and 40*d* (FIG. 2) are disengaged using manipulator arm 20*a* on ROV 20 (FIG. 1), such as by unthreading if pins 40 are threaded bolts. With ramming apparatus 12 (FIG. 1) disengaged from pile 18, winch 16*a* and crane boom 16*c* on ship 16 are used to pull the ramming apparatus up to the deck of ship 16 for connection to another pile, and the pile-driving process is repeated.

Particular Embodiments of the Invention

The present invention provides in one embodiment a system for driving an object into soil under water, which comprises a hammer element; a frame structure in which the hammer element is received; a piston cylinder received in the frame structure; a piston received in the piston cylinder; and a piston rod having an upper end attached to the piston and a lower end; a coupler attached to the hammer element, wherein the lower end of the piston rod is fastened to the coupler, and wherein the coupler is adapted to allow the piston rod to move up and down with respect to the hammer element within a limited range; a set of hydraulic elements received in or attached to the frame structure and in fluid communication with the piston cylinder; a surface structure on the surface of the water (which may be a ship or a barge adapted as a working vessel or a platform secured to soil under water or to soil adjacent to the water); a lifting line extending between the surface structure and the frame structure; a remotely operated vehicle (ROV) adapted to operatively connect to the set of hydraulic elements; and an umbilical cable extending between the surface structure and the ROV, the umbilical cable being adapted to provide electricity and/or control signals from the surface structure to the ROV for causing the hammer element to reciprocate and thereby deliver blows for driving the object into soil under water.

The coupler preferably comprises a hollow, tubular rod connector element having a lower end and an upper end; a hammer connector element having a longitudinal portion and a transverse portion, wherein the transverse portion is received inside the hollow, tubular rod connector element, and a spring device received within the hollow, tubular rod connector element between the upper end of the hollow, tubular rod connector element and the transverse portion of the hammer connector element, wherein the hammer connector element can reciprocate to a limited extent with respect to the hollow, tubular rod connector element. In one embodiment, the coupler comprises a tubular member having opposing slots that are oriented with a vertical longitudinal axis, the slots having a lower end and an upper end; a pin having a longitudinal axis oriented horizontally, the pin being received in the slots such that the pin contacts the lower end of the slots to provide an essentially rigid connection between the piston rod and the hammer element while the hammer element is lifted; and a spring mechanism received within the tubular member above the pin, wherein the spring mechanism has a bias for pushing the pin downwardly away from the upper ends of the slots. In another embodiment, the coupler comprises a tubular element having upper and lower ends and a longitudinal axis; a T-shaped element having a longitudinal portion and a transverse portion, wherein the transverse portion is slideably received in the tubular element, and wherein the longitudinal portion has a longitudinal axis that is essentially co-axial with the longitudinal axis of the tubular element; and a spring device received in the tubular element between the upper end of the tubular element and the transverse portion of the T-shaped element, wherein the spring device is adapted to push the transverse portion toward the lower end of the tubular element.

The hammer element preferably comprises a hammer mass; an upper hammer mass guide extending axially upwardly from the hammer mass; and a lower hammer mass guide extending axially downwardly from the hammer mass; where the frame structure has an upper opening adapted to receive the upper hammer mass guide and a lower opening adapted to receive the lower hammer mass guide. Preferably, the hammer mass has an axial bore; the upper and the lower hammer mass guides each have a bore aligned with the bore in the hammer mass; the coupler is attached to the hammer mass or to the upper or lower hammer mass guides and is located within the bore of the hammer mass or in the bore of the upper or the lower hammer mass guides; and the piston rod extends downwardly within the bore of the upper hammer mass guide. The frame structure is preferably adapted to allow ingress and egress of water so that the hammer mass is in contact with water while under water.

The set of hydraulic elements preferably includes a lift mechanism for lifting the hammer element; a release mechanism for releasing the hammer element after the hammer element is lifted; and a push mechanism, where the push mechanism is adapted to push the hammer element downwardly with the piston rod after the hammer element is released. The push mechanism preferably includes a tuneable gas spring comprising a vessel in fluid communication with the hydraulic circuit adapted to contain a gas that compresses and stores energy as the hammer element is lifted. The coupler is preferably adapted to prevent the piston rod from pushing the hammer element downwardly at about the moment that the hammer element reaches its lowermost point. The coupler is preferably adapted such that the connection between the piston rod and the hammer is essentially rigid while the hammer is lifted upwardly but the connection between the piston rod and the hammer is not rigid at the time the hammer reaches its lowermost point. In one embodiment of the coupler, the transverse portion of the hammer connector element presses against the lower end of the hollow, tubular rod connector element while the hammer element is lifted to provide an essentially rigid connection between the piston rod and the hammer element, and the transverse portion of the hammer connector element moves away from the lower end of the hollow, tubular rod connector element and presses against the spring device as the hammer element is pushed downwardly.

Other embodiments of the invention include the various embodiments of the ramming, pile-driving, soil-sampling, or hammering apparatus described herein, as well as the various optional accessories to the apparatus, such as the external power source and the pile cap or skirt, and the various methods for using the various embodiments of the apparatus and of the system and the various applications for the invention.

Applications

The present invention can be adapted for operation in water at a depth greater than about 1,000 feet, preferably greater than about 3,000 feet, more preferably greater than about 5,000 feet and most preferably greater than about 7,000 feet. Design and operation of the present invention is primarily independent of the depth of the water since the hammer operates in contact with water, but the hydraulic system should be designed appropriately for the anticipated depth, particularly the tuneable gas spring. The present invention can be adapted for operation at a depth of about 10,000 feet, which is about 3,000 meters. In addition to various underwater pile-driving applications, there are a number of other applications for which the ramming system of the present invention is particularly useful, including installation of well conductors, stabilization of mud mats, and installation of pin piles.

In offshore areas, deep-water wells are commonly initiated by jetting in an initial well conductor, which is typically a pipe having a diameter ranging from about 30 to about 36 inches in which a smaller-diameter pipe is installed for an oil well. Well conductors are installed from a drill ship or a semi-submersible drilling rig at enormous expense due to high rental rates. Additionally, the jetting process weakens the soil. Using a driven pile installed with an underwater hammer according to the present invention, the soil will be weakened much less than if a jetted pile is used. Thus, a shorter well conductor can be used that provides vertical and lateral support that is equivalent to a longer jetted well conductor. A shorter well conductor provides significant advantages in that a smaller ship can be used to pre-install the driven conductors, as is done in shallow waters.

Mud mats are large, structurally-reinforced panel structures installed on the ocean floor that are used in the oil and gas industry to support heavy subsea equipment or wellhead equipment. See, for example, U.S. Pat. No. 5,244,312, issued to Wybro et al. and incorporated by reference. Mudmats resist lateral force by means of vertical plates called skirts and resist vertical loading and overturning moments by the bearing area of the mudmat resting on the seafloor. The mat area and thus the submerged weight of these mats can be reduced considerably by using supplemental piles installed through pile guides positioned around the periphery of the mat. The addition of the piles allow the mat area to be reduced, while increasing the capacity of the mat to resist a lateral force and the capacity to resist overturning moments applied to the mat. The combined mudmat pile foundation reduces material costs, reduces design complexity, and reduces ship and crane capacity required to install the complete pile and mudmat foundation system.

Pin piles are smaller piles for applications where piles of typical sizes are too large. One application for pin piles is pipeline stabilization. The position of a pipeline often needs to be controlled during installation to a set alignment along the inside radius of the pipeline curvature or along the downslope side of the pipeline as it crosses a steep slope. A deep-water pipeline can be anchored using pin piles installed cost effectively using the hammering system of the present invention.

The present invention can be used for acquiring samples of soil from the seabed by driving a pipe-shaped device into the subsea soil. In order to characterize soil types and their strengths offshore, soil samples are often taken, which should be carefully extracted and returned to a laboratory for further testing and study. In deep water, considerable effort and expense must be expended to take soil samples, since drilling and sampling requires a rig, a reaction mass, and specialized sampling equipment to recover good, undisturbed soil samples. Soil sampling could be done more quickly using the hammer assembly of the present invention and would not require special rigs and sampling equipment.

A key advantage or benefit of the present invention in the various deep-water applications is a reduction in cost and time. Prior art equipment and methods for these applications require a large drilling vessel or construction barge that commands a very high rental rate. By scaling down the size of the cylindrical embedded object (pile, conductor or sampler), a smaller underwater piling hammer according to the present invention can be used to drive the object into the seabed. The vessel size and handling equipment can also be scaled down in size, reducing the rental cost for a vessel and possibly reducing the amount of time required to complete a job. In addition to time and cost advantages, the piling equipment of the present invention can be used more easily than prior art piling equipment for repairing subsea structures such as used in oil and gas production, and such subsea structures can be more easily modified and adapted to changing needs over the life of the installation. Using the deep-water pile driver of the present invention, it may be possible for an entire subsea oil and gas production system to be made smaller, without reducing production capacity, and the production system can be removed later with smaller vessels or barges.

The hammering or ramming apparatus of the present invention may also be used in shallow water and land-based applications. For land-based applications, ramming apparatus 30 of FIG. 2 can be installed on a truck with a crane, and power for the ramming apparatus can be supplied from equipment on the truck. Ramming apparatus 30 can also be operated from a barge for shallow water applications and from a structure anchored to an ocean floor. Ramming apparatus 30 can be used in salt water and in fresh water.

Having described the invention above, various modifications of the techniques, procedures, materials, and equipment will be apparent to those skilled in the art. It is intended that all such variations within the scope and spirit of the invention be included within the scope of the appended claims. The appended claims are incorporated by reference into this specification to ensure support in the specification for the claims.

What is claimed is:

1. A system for driving an object into soil under water, comprising:

a hammer element;

a frame structure in which the hammer element is received;

a piston cylinder received in the frame structure; a piston received in the piston cylinder; and a piston rod having an upper end attached to the piston and a lower end;

a coupler attached to the hammer element, wherein the lower end of the piston rod is fastened to the coupler, and wherein the coupler is adapted to allow the piston rod to move up and down with respect to the hammer element within a limited range;

a set of hydraulic elements received in or attached to the frame structure and in fluid communication with the piston cylinder;

a surface structure on the surface of the water;

a lifting line extending between the surface structure and the frame structure;

a remotely operated vehicle (ROV) adapted to operatively connect to the set of hydraulic elements; and an umbilical cable extending between the surface structure and the ROV, the umbilical cable being adapted to provide electricity and/or control signals from the surface structure to the ROV for causing the hammer element to reciprocate and thereby deliver blows for driving the object into soil under water.

2. The system of claim 1, wherein the coupler comprises:

a hollow, tubular rod connector element having a lower end and an upper end;

a hammer connector element having a longitudinal portion and a transverse portion, wherein the transverse portion is received inside the hollow, tubular rod connector element, and a spring device received within the hollow, tubular rod connector element between the upper end of the hollow, tubular rod connector element and the transverse portion of the hammer connector element, wherein the hammer connector element can reciprocate to a limited extent with respect to the hollow, tubular rod connector element.

3. The system of claim 2, wherein the coupler comprises:

a tubular member having opposing slots that are oriented with a vertical longitudinal axis, the slots having a lower end and an upper end;

a pin having a longitudinal axis oriented horizontally, the pin being received in the slots such that the pin contacts the lower end of the slots to provide an essentially rigid connection between the piston rod and the hammer element while the hammer element is lifted; and a spring mechanism received within the tubular member above the pin, wherein the spring mechanism has a bias for pushing the pin downwardly away from the upper ends of the slots.

4. The system of claim 2, wherein the coupler comprises:

a tubular element having upper and lower ends and a longitudinal axis;

a T-shaped element having a longitudinal portion and a transverse portion, wherein the transverse portion is slideably received in the tubular element, and wherein the longitudinal portion has a longitudinal axis that is essentially co-axial with the longitudinal axis of the tubular element; and a spring device received in the tubular element between the upper end of the tubular element and the transverse portion of the T-shaped element, wherein the spring device is adapted to push the transverse portion toward the lower end of the tubular element.

5. The system of claim 1, wherein the hammer element comprises:

a hammer mass;

an upper hammer mass guide extending axially upwardly from the hammer mass; and a lower hammer mass guide extending axially downwardly from the hammer mass; and wherein the frame structure has an upper opening adapted to receive the upper hammer mass guide and a lower opening adapted to receive the lower hammer mass guide.

6. The system of claim 5, wherein:

the hammer mass has an axial bore;

the upper and the lower hammer mass guides each have a bore aligned with the bore in the hammer mass;

the coupler is attached to the hammer mass or to the upper or lower hammer mass guides and is located within the bore of the hammer mass or in the bore of the upper or the lower hammer mass guides; and the piston rod extends downwardly within the bore of the upper hammer mass guide.

7. The system of claim 6, wherein the frame structure is adapted to allow ingress and egress of water so that the hammer mass is in contact with water while under water.

8. The system of claim 1, wherein the set of hydraulic elements includes:

a lift mechanism for lifting the hammer element;

a release mechanism for releasing the hammer element after the hammer element is lifted; and a push mechanism, wherein the push mechanism is adapted to push the hammer element downwardly with the piston rod after the hammer element is released.

9. The system of claim 8, wherein the coupler is adapted to prevent the piston rod from pushing the hammer element downwardly at about the moment that the hammer element reaches its lowermost point.

10. The system of claim 1, wherein:

the hammer element comprises:

a hammer mass having an axial bore;

an upper hammer mass guide extending axially upwardly from the hammer mass; and a lower hammer mass guide extending axially downwardly from the hammer mass; and wherein the frame structure has an upper opening adapted to receive the upper hammer mass guide and a lower opening adapted to receive the lower hammer mass guide, wherein the upper and the lower hammer mass guides each have a bore aligned with the bore in the hammer mass, wherein the coupler is attached to the hammer mass or to the upper or lower hammer mass guides and is located within the bore of the hammer mass or in the bore of the upper or the lower hammer mass guides, wherein the piston rod extends downwardly within the bore of the upper hammer mass guide, and wherein the coupler is adapted such that the connection between the piston rod and the hammer is essentially rigid while the hammer is lifted upwardly but the connection between the piston rod and the hammer is not rigid at the time the hammer reaches its lowermost point.

11. The system of claim 10, wherein the frame structure is elongated and has a longitudinal axis that is oriented generally vertically while the hammer element is operated, and wherein the frame structure has an upper end and a lower end, further comprising a skirt extending from the lower end of the frame structure, wherein the skirt is adapted to fit over the object that is to be driven by the hammer element, and wherein the skirt is adapted to hold the object while the object is lowered through the water.

12. The system of claim 1, wherein:

the hammer element comprises:

a hammer mass having an axial bore;

an upper hammer mass guide extending axially upwardly from the hammer mass; and a lower hammer mass guide extending axially downwardly from the hammer mass; and wherein the frame structure has an upper opening adapted to receive the upper hammer mass guide and a lower opening adapted to receive the lower hammer mass guide, wherein the upper and the lower hammer mass guides each have a bore aligned with the bore in the hammer mass, wherein the coupler is attached to the hammer mass or to the upper or lower hammer mass guides and is located within the bore of the hammer mass or in the bore of the upper or the lower hammer mass guides, wherein the piston rod extends downwardly within the bore of the upper hammer mass guide, wherein the coupler comprises:

a hollow, tubular rod connector element having a lower end and an upper end;

a hammer connector element having a longitudinal portion and a transverse portion, wherein the transverse portion is received inside the hollow, tubular rod connector element, and a spring device received within the hollow, tubular rod connector element between the upper end of the hollow, tubular rod connector element and the transverse portion of the hammer connector element, wherein the hammer connector element can reciprocate to a limited extent with respect to the hollow, tubular rod connector element, wherein the frame structure has an upper end and a lower end and includes a hydraulics sub-frame attached to the upper end, wherein at least some of the elements in the set of hydraulic elements are located in the hydraulics sub-frame, and wherein the attachment of the hydraulics sub-frame includes shock and vibration isolators for insulating the hydraulic elements in the hydraulics sub-frame from the impact shock that occurs when the hammer element delivers blows.

13. The system of claim 2, wherein:

the hammer element comprises:

a hammer mass having an axial bore;

an upper hammer mass guide extending axially upwardly from the hammer mass; and a lower hammer mass guide extending axially downwardly from the hammer mass; and wherein the frame structure has an upper opening adapted to receive the upper hammer mass guide and a lower opening adapted to receive the lower hammer mass guide, wherein the upper and the lower hammer mass guides each have a bore aligned with the bore in the hammer mass, wherein the coupler is attached to the hammer mass or to the upper or lower hammer mass guides and is located within the bore of the hammer mass or in the bore of the upper or the lower hammer mass guides, wherein the piston rod extends downwardly within the bore of the upper hammer mass guide, wherein the set of hydraulic elements includes a push mechanism adapted to push the hammer element downwardly through the piston rod after the hammer element is released, and wherein the coupler is adapted such that the connection between the piston rod and the hammer element is essentially rigid while the hammer is lifted upwardly but the connection between the piston rod and the hammer element is essentially not rigid when the hammer element reaches its lowermost point.

14. The system of claim 13, wherein the set of hydraulic elements includes a hydraulic circuit adapted to lift the piston and thereby lift the hammer element, and wherein the push mechanism includes a tuneable gas spring comprising a vessel in fluid communication with the hydraulic circuit adapted to contain a gas that compresses and stores energy as the hammer element is lifted.

15. The system of claim 14, wherein the set of hydraulic elements includes a release mechanism, wherein the push mechanism is adapted to push the hammer element downwardly through the piston rod after the hammer element is released, wherein the transverse portion of the hammer connector element presses against the lower end of the hollow, tubular rod connector element while the hammer element is lifted to provide an essentially rigid connection between the piston rod and the hammer element, and wherein the transverse portion of the hammer connector element moves away from the lower end of the hollow, tubular rod connector element and presses against the spring device as the hammer element is pushed downwardly.

16. The system of claim 2, wherein the structure on the surface of the water is a ship or a barge adapted as a working vessel, or wherein the structure on the surface of the water is a platform secured to soil under water or to soil adjacent to the water.

17. A method for driving an object into soil below water, comprising the steps of:

lowering a ramming apparatus into a body of water, wherein the ramming apparatus comprises:

a frame structure having an upper end and a lower end, wherein the frame structure is adapted to allow water to flow into and out of the frame structure;

a hammer received in the frame structure and adapted to operate while in contact with water;

a hydraulic cylinder received in the frame structure;

a piston received in the hydraulic cylinder;

a coupler attached to the hammer;

a piston rod attached to and extending between the piston and the coupler, wherein the coupler is adapted such that the connection between the piston rod and the hammer is essentially rigid while the hammer is lifted upwardly but the connection between the piston rod and the hammer is essentially not rigid when the hammer reaches its lowermost point; and a first hydraulic circuit adapted to lift the hammer via the hydraulic cylinder, piston and piston rod and to release the hammer, whereby the release of the hammer allows the hammer to fall due to gravity, wherein the ramming apparatus is adapted to impart a ramming force on the object that is to be driven into soil below water;

lowering a remotely operated vehicle (ROV) into the water, wherein the ROV is adapted to have a second hydraulic circuit, and wherein the ROV is adapted for remote control that allows the ROV:

to be moved under the water by a propulsion system on the ROV, and to connect the second hydraulic circuit on the ROV to the first hydraulic circuit on the ramming apparatus, and wherein the ROV and the first and second hydraulic circuits provide a capability for operating the ramming apparatus through the ROV; and using the ramming apparatus to drive the object into soil below the water.

18. The method of claim 17, wherein the object to be driven into soil below the water is a pipe, and wherein the pipe is to be used as a well conductor.

19. The method of claim 17, wherein the object to be driven into soil below the water is a pile.

20. The method of claim 19, further comprising installing a mud mat, wherein a plurality of piles is used to anchor the mud mat to the soil below the water.

21. The method of claim 19, further comprising anchoring a pipeline to the soil below the water.

22. The method of claim 19, further comprising anchoring equipment and/or a structural element to the soil below the water.

23. The method of claim 22, wherein the equipment and/or the structural element is used in the production of oil and/or gas.

24. The method of claim 17, wherein the object to be driven into soil below the water is a soil sampling device.

25. The method of claim 17, wherein the ramming apparatus and the first hydraulic circuit are adapted to push the hammer downwardly after the hammer is released.

26. The method of claim 25, wherein the first hydraulic circuit includes a tuneable gas spring comprising a tank containing a gas that is compressed as the hammer is lifted, wherein after release of the hammer, the gas expands, which provides a force for pushing the hammer downwardly.

27. The method of claim 17, further comprising providing a ship having a crane for lowering the ramming apparatus, wherein a wire rope extends from the crane to the ramming apparatus for holding the ramming apparatus, wherein no electricity, air and/or control signals are provided to the ramming apparatus other than through the ROV, and wherein the depth of the water exceeds 3,000 feet.

28. The method of claim 27, wherein the frame structure includes a skirt attached to the lower end of the frame, wherein the skirt is adapted to hold the object that is to be driven into the soil, further comprising lowering the object from the ship and through the water.

29. The method of claim 17, further comprising ramming the object into the soil initially with drops of the ram from a first height and ramming the object into the soil subsequently with drops of the ram from a second height, wherein the second height is greater than the first height.

30. A ramming apparatus, comprising:

a hammer frame having an upper end and a lower end and a side wall extending between the upper and lower ends, wherein the side wall has water openings adapted for the passage of water through the side wall;

a hammer received in the hammer frame, wherein the hammer comprises a heavy body having upper and lower surfaces, an upper hammer guide extending upwardly from the upper surface of the heavy body and a lower hammer guide extending downwardly from the lower surface of the heavy body, wherein the upper hammer guide, the heavy body and the lower hammer guide have a co-axial bore, wherein the frame has an upper guide opening for receiving the upper hammer guide and a lower guide opening for receiving the lower hammer guide, wherein the frame and the hammer are adapted for reciprocation of the hammer inside the frame, and wherein the hammer is adapted for operation while in contact with water;

an anvil in the lower end of the hammer frame, the anvil being adapted to receive and transmit the force of impact from the hammer;

a hydraulics frame coupled to the upper end of the hammer frame;

a hydraulic cylinder received in the hydraulics frame;

a piston received in the hydraulic cylinder;

a piston rod having one end attached to the piston;

a coupling mechanism adapted to couple the other end of the piston rod to the hammer, wherein the coupling mechanism provides an essentially rigid connection between the piston rod and the hammer as the hammer is lifted and an essentially non-rigid connection between the piston rod and the hammer as the hammer impacts the anvil; and a hydraulic fluid circuit adapted to provide a lifting force for lifting the hammer and to release the hammer.

31. The ramming apparatus of claim 30, wherein the hydraulic fluid circuit includes a tuneable gas spring comprising a container in which a gas is stored, wherein the gas is compressed as the hammer is lifted, wherein the gas expands after the hammer is released, and wherein the expansion of the gas provides a downward force that is used to push the hammer downwardly.

32. The ramming apparatus of claim 31, wherein the downward force from the expanding gas is transmitted through the piston rod to the hammer through the coupling mechanism, and wherein the coupling mechanism and/or the hydraulic fluid circuit is adapted to prevent the piston rod from slamming hard and rigidly into the hammer at about the moment that the anvil receives the force of the impact from the hammer.

33. The ramming apparatus of claim 32, wherein the coupling mechanism comprises:

a hollow, tubular rod connector element having a lower end and an upper end;

a hammer connector element having a longitudinal portion and a transverse portion, wherein the transverse portion is received inside the hollow, tubular rod connector element; and a spring device received within the hollow, tubular rod connector element between the upper end of the hollow, tubular rod connector element and the transverse portion of the hammer connector element, wherein the hammer connector element can reciprocate to a limited extent with respect to the hollow, tubular rod connector element.

34. The ramming apparatus of claim 33, wherein the transverse portion of the hammer connector element presses against the lower end of the hollow, tubular rod connector element while the hammer is lifted to provide an essentially rigid connection between the piston rod and the hammer, and wherein the transverse portion of the hammer connector element moves away from the lower end of the hollow, tubular rod connector element and presses against the spring device as the hammer is pushed downwardly, and wherein the downward speed of the piston rod is slowed immediately before the hammer impacts the anvil.

35. The ramming apparatus of claim 30, wherein the hydraulic fluid circuit is adapted to be operated by a remotely-operated drive unit or to be operated by a remotely-operated vehicle (ROV) having a propulsion system, and wherein the ramming apparatus is adapted for operation below about 3,000 feet of water.

36. The ramming apparatus of claim 30, further comprising a skirt extending from the lower end of the hammer frame, wherein the skirt is adapted for contact with an object that is to be driven into soil, and wherein the skirt is adapted to receive and transmit the force of impact from the hammer to the object that is to be driven into soil.

* * * * *